US008909092B2

(12) United States Patent
Koyama et al.

(10) Patent No.: US 8,909,092 B2
(45) Date of Patent: Dec. 9, 2014

(54) PROCESS CARTRIDGE AND ELECTROPHOTOGRAPHIC IMAGE FORMING APPARATUS TO CHARGE A PHOTOSENSITIVE DRUM

(75) Inventors: Osamu Koyama, Mishima (JP); Kazuo Chadani, Suntou-gun (JP); Yasunori Toriyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 146 days.

(21) Appl. No.: 13/420,916

(22) Filed: Mar. 15, 2012

(65) Prior Publication Data

US 2012/0275815 A1 Nov. 1, 2012

(30) Foreign Application Priority Data

Mar. 24, 2011 (JP) ..... 2011-066251
Feb. 10, 2012 (JP) ..... 2012-027513

(51) Int. Cl.
*G03G 21/18* (2006.01)
*G03G 21/10* (2006.01)

(52) U.S. Cl.
CPC ..... *G03G 21/1825* (2013.01)
USPC ..... 399/102; 399/111

(58) Field of Classification Search
USPC ..... 399/111, 113, 98, 223
See application file for complete search history.

(56) References Cited

U.S. PATENT DOCUMENTS

| | | | | |
|---|---|---|---|---|
| 7,903,994 | B2 * | 3/2011 | Matsumoto et al. | 399/98 |
| 8,116,664 | B2 * | 2/2012 | Kawamura | 399/223 |
| 2007/0160388 | A1 * | 7/2007 | Yoshimura et al. | 399/111 |

FOREIGN PATENT DOCUMENTS

| | | | |
|---|---|---|---|
| JP | 2001-305925 | A | 11/2001 |
| JP | 2002-6722 | A | 1/2002 |
| JP | 2003-208073 | A | 7/2003 |
| JP | 2004-341118 | A | 12/2004 |
| JP | 2005-242066 | A | 9/2005 |
| JP | 2008-170950 | A | 7/2008 |
| JP | 2008-170961 | A | 7/2008 |
| JP | 2008-170965 | A | 7/2008 |

* cited by examiner

*Primary Examiner* — Quana M Grainger
(74) *Attorney, Agent, or Firm* — Canon USA Inc IP Division

(57) ABSTRACT

A support member disposed in a photosensitive member unit for supporting a photosensitive drum to be movable between an acting position, at which the photosensitive drum is brought into contact with a process unit, and a non-acting position, at which the photosensitive drum is separated from the process unit or is brought into contact with the process unit with a pressure lower than a pressure with which the photosensitive drum contacts the process unit at the acting position is included, and when the developing unit is located at a development position, the photosensitive drum secures the acting position, and when the developing unit is located at a non-development position, the photosensitive drum secures the non-acting position.

23 Claims, 23 Drawing Sheets

PROCESS CARTRIDGE AND ELECTROPHOTOGRAPHIC IMAGE FORMING APPARATUS TO CHARGE A PHOTOSENSITIVE DRUM

BACKGROUND OF THE INVENTION

1. Field of the Invention

The present disclosure relates to an electrophotographic image forming apparatus and a process cartridge that can detachably attach to an electrophotographic image forming apparatus.

2. Description of the Related Art

Here, an electrophotographic image forming apparatus (hereinafter, also referred simply to as an "image forming apparatus") is an image forming apparatus that forms an image on a recording medium by using an electrophotographic image forming method. Examples of the image forming apparatus include an electrophotographic copying machine, an electrophotographic printer (for example, a laser beam printer, an light-emitting diode (LED) printer, or the like), a facsimile apparatus, and a multifunction peripheral (multifunction printer) thereof, and the like.

In addition, the process cartridge refers to a device in which at least a developing unit as a process unit and an electrophotographic photosensitive drum are integrally configured as a process cartridge to be detectably attached to an image forming main assembly.

Conventionally, in image forming apparatuses using an electrophotographic image forming process, an electrophotographic photosensitive member and a process unit that acts on the electrophotographic photosensitive member are integrally configured as a process cartridge.

Thus, a process cartridge type is employed which enables the process cartridge to be detachably attached to the image forming main assembly. According to the process cartridge type, the maintenance of an apparatus is performed not by a service staff but by a user, whereby the operability can be markedly improved.

For the process cartridge, a contact developing method is adopted in which developing is performed in a state in which a development roller is brought into contact with a photosensitive drum. According to the method, to maintain predetermined pressure between the development roller and the photosensitive drum, which are in the process of forming an image, a state is formed in which the development roller including an elastic layer is pressed to the photosensitive drum. However, when such a state is continued for a long time, the elastic layer of the development roller may be deformed to affect an image. Accordingly, for example, Japanese Patent Application Laid-Open No. 2008-170950 discuses a configuration in which the development roller is separated from the photosensitive drum by using a separation member at the time of no image formation.

In addition, for a charging roller as a unit that charges the photosensitive drum, a contact charging method is widely used in which the charging roller is brought into contact with the photosensitive drum. Also in such a case, since it is necessary to reliably bring the charging roller into contact with the surface of the photosensitive drum, the charging roller is brought into contact with the surface of the photosensitive drum at predetermined pressure. Thus, when such a state is continued for a long time, an elastic layer of the charging roller may be deformed to affect an image. Accordingly, for example, Japanese Patent Application Laid-Open No. 2002-6722 and Japanese Patent Application Laid-Open No. 2008-170965 discuss a configuration in which the charging roller is separated from the photosensitive drum by using a separation member at the time of no image formation.

Furthermore, a photosensitive member unit includes a cleaning blade that is used for removing toner adhering to the photosensitive drum after transfer. To scrape off the toner adhering to the photosensitive drum, the cleaning blade is in the state of being pressed to the photosensitive drum. Thus, for example, Japanese Patent Application Laid-Open No. 2001-305925 discusses a configuration in which the pressing force of the cleaning blade toward the photosensitive drum at a time when the process cartridge is separated is reduced.

SUMMARY OF THE INVENTION

The present disclosure is directed to providing a process cartridge and an image forming apparatus that can maintain a process unit, which acts on the photosensitive drum by being brought into contact therewith, in a state of being separated from the photosensitive drum or a state in which the pressing force is reduced by employing a simple configuration.

According to an aspect of the present disclosure, there is provided a process cartridge detachably attached to a main assembly of an electrophotographic image forming apparatus, the process cartridge including: a photosensitive member unit that includes a photosensitive drum; a development roller that develops an electrostatic latent image formed on the photosensitive drum using a developer; a developing unit that includes the development roller, is combined with the photosensitive member unit to be movable, and secures a development position, which the developing roller can develop the electrostatic latent image, and a non-development position, which the developing roller retreats from the development position; a process unit that acts on the photosensitive drum by contacting the photosensitive drum; and a support member disposed within the photosensitive member unit for supporting the photosensitive drum to be movable between an acting position, which the photosensitive drum is brought into contact with the process unit, and a non-acting position, which the photosensitive drum is separated from the process unit or is brought into contact with the process unit with a pressure lower than a pressure with which the photosensitive drum contacts with the process unit at the acting position and, wherein, the photosensitive drum secures the acting position when the developing unit is located at the development position, and, the photosensitive drum secures the non-acting position when the developing unit is located at the non-development position.

According to another aspect of the present disclosure, there is provided an electrophotographic image forming apparatus for forming an image on a recording medium, the apparatus including a process cartridge including: a photosensitive member unit that includes a photosensitive drum, a development roller that develops an electrostatic latent image formed on the photosensitive drum using a developer, a developing unit that includes the development roller, is combined with the photosensitive member unit to be movable, and secures a development position at which the developing roller develops the electrostatic latent image and a non-development position at which the developing roller retreats from the development position; a process unit that acts on the photosensitive drum by contacting the photosensitive drum; and a support member disposed within the photosensitive member unit for supporting the photosensitive drum to be movable between an acting position, which the photosensitive drum is brought into contact with the process unit, and a non-acting position, which the photosensitive drum is separated from the process unit or is brought into contact with the process unit with a pressure lower than a pressure with which the photosensitive drum contacts with the process unit at the acting position, and wherein the photosensitive drum secures the acting position when the developing unit is located at the development position, and, the photosensitive drum secures the non-acting position when the developing unit is located at the non-development position; and a mounting unit configured to detachably attach the process cartridge.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the disclosure will be described in detail below with reference to the drawings.

Figure 1:
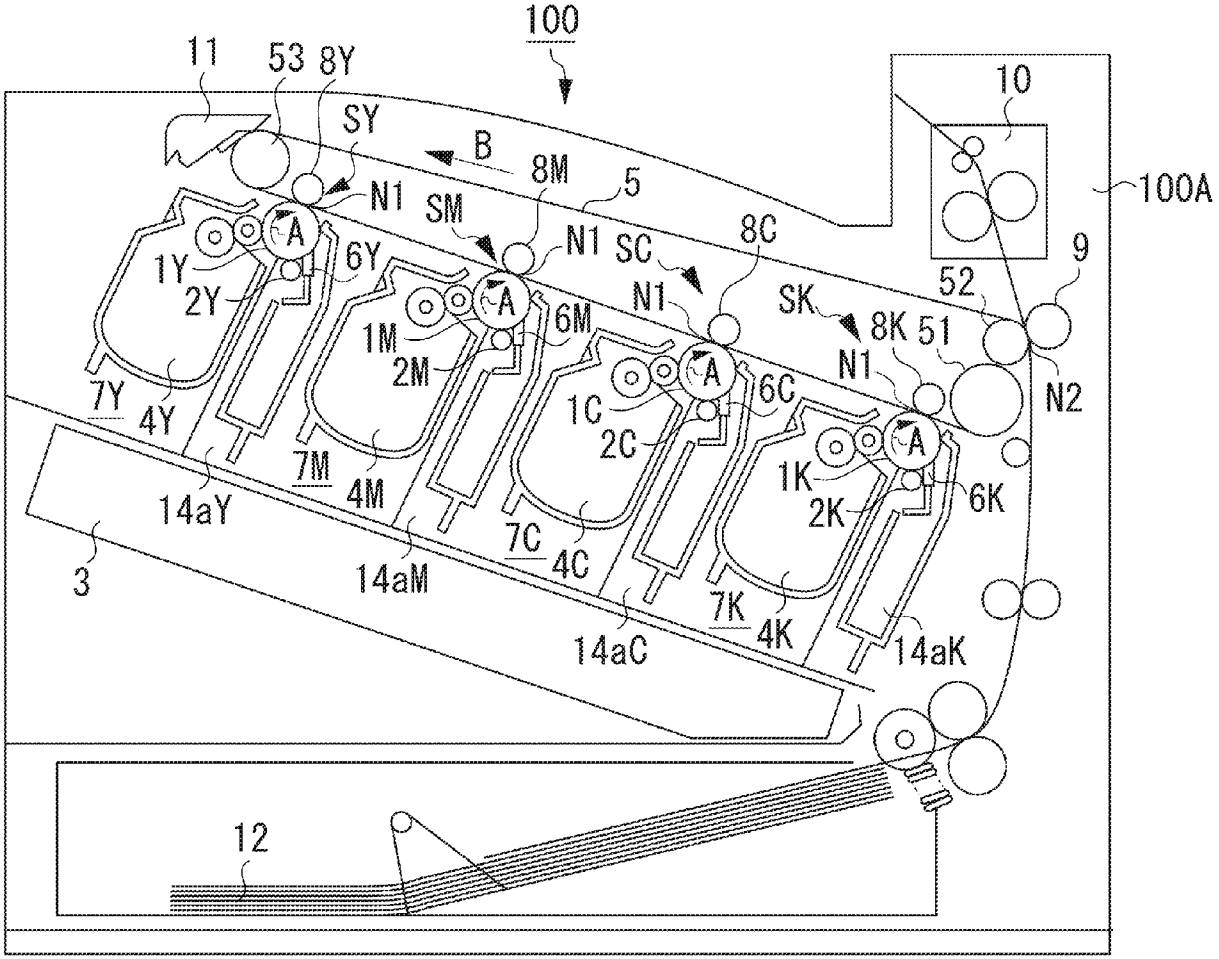
FIG. 1 is a schematic cross-sectional view of an image forming apparatus.

Hereinafter, a first exemplary embodiment will be described. FIG. 1 illustrates a schematic configuration of an image forming apparatus according to an exemplary embodiment of the present disclosure. In the present exemplary embodiment, the image forming apparatus is configured as a color image forming apparatus. However, the present disclosure is not limited to the color image forming apparatus but may be applied to a monochrome image forming apparatus or various other image forming apparatuses. First, the entire configuration of the color image forming apparatus according to the present exemplary embodiment will be described.

Now, the entire configuration of the image forming apparatus will be described. FIG. 1 is a schematic cross-sectional view of an electrophotographic image forming apparatus (hereinafter, referred to as an image forming apparatus) 100 according to the present exemplary embodiment. The image forming apparatus 100 according to the present exemplary embodiment is a full-color laser beam printer as a color electrophotographic image forming apparatus that employs an in-line system and an intermediate transfer system. The image forming apparatus 100 can form a full-color image on a recording medium (for example, a recording paper sheet, a plastic sheet, a cloth, or the like) according to image information. The image information is input to an image forming main assembly from an image reading device connected to the image forming main assembly or a host apparatus such as a personal computer that is communicably connected to the image forming main assembly.

The image forming apparatus 100 includes first, second, third, and fourth image forming units SY, SM, SC, and SK that are used for forming images of colors yellow (Y), magenta (M), cyan (C), and black (K) respectively as a plurality of image forming units. In the present exemplary embodiment, the first to fourth image forming units SY, SM, SC, and SK are arranged in one row in a direction intersecting the vertical direction.

In the present exemplary embodiment, the configurations and the operations of the first to fourth image forming units are substantially the same except that the colors of images to be formed are different. Accordingly, hereinafter, in a case where it is not necessary to particularly identify an image forming unit, the image forming unit will be collectively described by omitting a subscript Y, M, C, or K assigned to the reference numeral to represent an element arranged for any one color.

In other words, in the present exemplary embodiment, the image forming apparatus 100 includes four drum-type electrophotographic sensitive members arranged in parallel in the direction intersecting the vertical direction, in other words, the photosensitive drums 1 as a plurality of image carriers. The photosensitive drum 1 is driven to rotate by a driving source (not illustrated in the figure) in a direction (clockwise direction) of arrow A illustrated in the figure. On the periphery of the photosensitive drum 1, a charging roller 2 as a charging unit that uniformly charges the surface of the photosensitive drum 1 and a scanner unit (exposure device) 3 as an exposure unit that forms an electrostatic latent image on the photosensitive drum 1 by emitting a laser beam thereto based on the image information are arranged. In addition, on the periphery of the photosensitive drum 1, a developing unit 4 as a developing member that forms a developed image by developing the electrostatic latent image and a cleaning blade 6 as a cleaning unit that removes a developer (hereinafter, referred to as toner) that remains on the surface of the photosensitive drum 1 after transfer are arranged. Furthermore, an intermediate transfer belt 5 as an intermediate transfer member that is used for transferring a toner image formed on the photosensitive drum 1 onto the recording medium 12 is arranged to face four photosensitive drums 1. In the rotation direction of the photosensitive drum 1, a charging position according to the charging roller 2, an exposure position according to the scanner unit 3, a developing position according to the developing unit 4, a transfer position of a toner image on the intermediate transfer belt 5, and a cleaning position according to the cleaning blade 6 are disposed in this order.

In the present exemplary embodiment, the developing unit 4 uses a nonmagnetic single-component developer, that is, toner as the developer. In the present exemplary embodiment, the developing unit 4 performs reversal developing by bringing the development roller as a developer bearing member into contact with the photosensitive drum 1. In other words, in the present exemplary embodiment, the developing unit 4 develops an electrostatic latent image by allowing toner that is charged with the same polarity (in the present exemplary embodiment, the negative polarity) as the polarity of the charged photosensitive drum 1 to adhere to a portion (an image portion or an exposed portion) at which the charge is decreased through exposure on the photosensitive drum 1.

In the present exemplary embodiment, the photosensitive drum 1 and the charging roller 2, the developing unit 4, and the cleaning blade 6 as process members that act on the photosensitive drum 1 are integrally configured as a process cartridge to form a process cartridge 7 (hereinafter, referred to as a cartridge). The cartridge 7 can be detachably attached to an image forming main assembly 100A (hereinafter, referred to as a main assembly) through mounting members such as a mounting guide and a positioning member disposed in the main assembly 100A. In the present exemplary embodiment, all the cartridges 7 of each color have the same shape, and toner of each color yellow (Y), magenta (M), cyan (C), or black (K) is housed inside the cartridge 7 of each color.

The endless-shaped intermediate transfer belt 5 as an intermediate transfer member is brought into contact with all the photosensitive drums 1 and is circulated (rotated) in a direction of arrow B (counterclockwise direction) illustrated in the figure. The intermediate transfer belt 5 hangs over a driving roller 51, a secondary transfer counter roller 52, and a driven roller 53 as a plurality of support members.

On the inner circumferential face side of the intermediate transfer belt 5, four primary transfer rollers 8 as primary transfer units are arranged in parallel to face the photosensitive drums 1. The primary transfer rollers 8 press the intermediate transfer belt 5 toward the photosensitive drums 1 and forms a nip (primary transfer nip) at a primary transfer portion N1 at which the intermediate transfer belt 5 and the photosensitive drum 1 are brought into contact with each other. Then, the primary transfer rollers 8 are applied with a bias having a polarity opposite to the normal polarity of charged toner from a primary transfer bias power supply (not illustrated in the figure). Accordingly, the toner image formed on the photosensitive drum 1 is transferred (primarily transferred) onto the intermediate transfer belt 5.

In addition, at a position facing the secondary transfer counter roller 52 on the outer circumferential face side of the intermediate transfer belt 5, a secondary transfer roller 9 is arranged. The secondary transfer roller 9 is brought into pressed contact with the secondary transfer counter roller 52 through the intermediate transfer belt 5 and forms a nip (secondary transfer nip) at a secondary transfer portion N2 at which the intermediate transfer belt 5 and the secondary transfer roller 9 are brought into contact with each other. Then, the secondary transfer roller 9 is applied with a bias having a polarity opposite to the normal polarity of charged toner from a secondary transfer bias power supply (not illustrated in the figure). Accordingly, the toner image formed on the intermediate transfer belt 5 is transferred (secondarily transferred) onto the recording medium 12. The primary transfer roller 8 and the secondary transfer roller 9 have the same configuration.

When an image is formed, first, the surface of the photosensitive drum 1 is uniformly charged by the charging roller 2. Thereafter, the surface of the charged photosensitive drum 1 is scanned by and exposed to a laser beam according to the image information generated by the scanner unit 3, and an electrostatic image according to the image information is formed on the photosensitive drum 1. Thereafter, the electrostatic image formed on the photosensitive drum 1 is developed as a toner image by the developing unit 4. The toner image formed on the photosensitive drum 1 is transferred (primarily transferred) onto the intermediate transfer belt 5 according to the action of the primary transfer roller 8.

For example, when a full-color image is formed, the above-described process is sequentially performed in the first to fourth image forming units SY, SM, SC, and SK, and the toner images of each color are sequentially superimposed on the intermediate transfer belt 5 to be primarily transferred.

Thereafter, a recording medium 12 is conveyed to the secondary transfer unit N2 in synchronization with the movement of the intermediate transfer belt 5. Then, the four-color toner images formed on the intermediate transfer belt 5 are secondarily transferred onto the recording medium 12 altogether according to the action of the secondary transfer roller 9 that is brought into contact with the intermediate transfer belt 5 through the recording medium 12.

The recording medium 12 onto which the toner images are transferred is conveyed to a fixing device 10 as a fixing unit. By applying heat and pressure to the recording medium 12 in the fixing device 10, the toner images are fixed to the recording medium 12.

In addition, primary transfer residual toner that remains on the photosensitive drums 1 after the primary transfer process is removed by the cleaning blade 6 and is recovered by a removal toner chamber 14*a*. In addition, secondary transfer residual toner that remains on the intermediate transfer belt 5 after the secondary transfer process is cleaned by an intermediate transfer belt cleaning device 11.

In addition, the image forming apparatus 100 is configured to form an image of a single color or multiple colors by using only a single image forming unit or several image forming units (not all the image forming units) that are desired as well.

Figure 2:
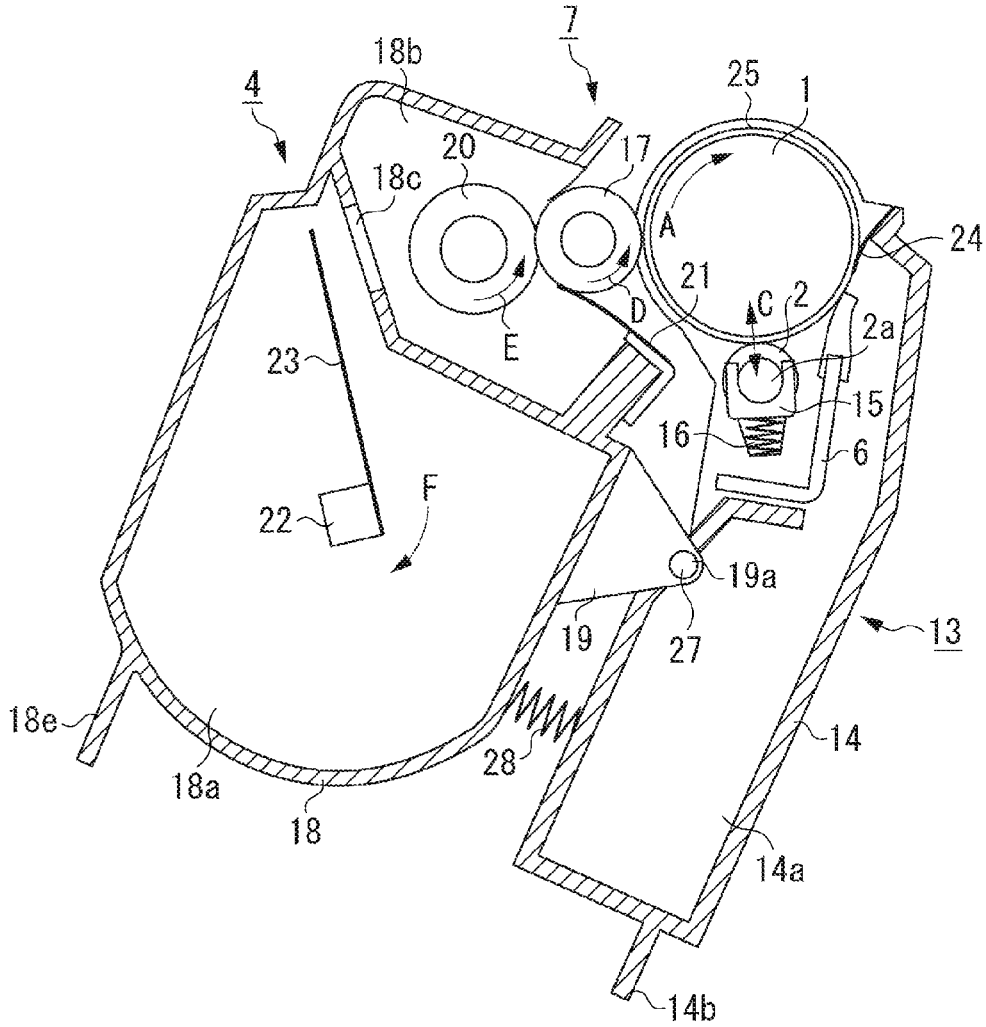
FIG. 2 is a schematic cross-sectional view of a process cartridge.

Next, the cartridge 7 according to the present exemplary embodiment will be described further with reference to FIG. 2. FIG. 2 is a main cross-sectional view of the cartridge 7 that is in the state of being mounted in the main assembly 100A.

In the present exemplary embodiment, a cartridge 7Y in which yellow toner is housed, a cartridge 7M in which magenta toner is housed, a cartridge 7C in which cyan toner is housed, and the cartridge 7K in which black toner is housed have the same configuration.

The cartridge 7 is divided into a photosensitive member unit 13 and a developing unit 4. Hereinafter, each unit will be described.

The photosensitive member unit 13 includes a photosensitive drum 1, a charging roller 2, and a cleaning blade 6. To a cleaning frame 14 of the photosensitive member unit 13, the photosensitive drum 1 is attached to be rotatable through a drum bearing 25 disposed in the cleaning frame 14. Then, by transferring a driving force of a driving motor (not illustrated in the figure) to the photosensitive member unit 13, the photosensitive drum 1 is driven to rotate in the direction of arrow A according to an image forming operation. On the periphery of the photosensitive drum 1, as described above, the charging roller 2 and the cleaning blade 6 are arranged. The residual toner removed from the surface of the photosensitive drum 1 by the cleaning blade 6 falls into the removal toner chamber 14*a*. On the upstream side of the cleaning blade 6 in the rotation direction of the photosensitive drum 1, a toner sealing member 24 is included, and the residual toner recovered inside the removal toner chamber 14*a* is prevented from being leaked to the outer side of the cleaning frame 14.

A charging roller bearing 15 is attached to the photosensitive member unit 13 to be movable in directions of arrows C passing through the center of the charging roller 2 and the center of the photosensitive drum 1. The shaft 2*a* of the charging roller 2 is attached to the charging roller bearing 15 to be rotatable, and the charging roller bearing 15 is in the state of being pressed by the charging roller pressing member 16 toward the photosensitive drum 1.

In a development container (hereinafter, referred to as a development frame) 18 of the developing unit 4, a developer housing chamber (hereinafter, referred to as a toner chamber) 18*a* that houses toner and a development chamber 18*b*, in which a development roller 17 as a developer bearing member that is brought into contact with the photosensitive drum 1 and rotates in the direction of arrow D is arranged, are disposed.

In the present exemplary embodiment, the development chamber 18*b* is arranged on the upper side of the toner chamber 18*a*, and the toner chamber 18*a* and the development chamber 18*b* communicate with each other in an opening portion 18*c* that is located on the upper side of the toner chamber 18*a*.

The development roller 17 disposed in the development chamber 18*b* is supported by the development frame 18 to be rotatable. In addition, on the periphery of the development roller 17, a developer supplying member (hereinafter, referred to as a toner supplying roller) 20 that is brought into contact with the development roller 17 and rotates in the direction of arrow E and a development blade 21 that is used for regulating a toner layer located on the development roller 17 are arranged.

A rotation shaft 22 is supported by the toner chamber 18*a* of the development frame 18 to be rotatable. On the rotation shaft 22, a developer conveyance member 23 that is used for stirring housed toner and conveying the toner to a toner supplying roller 20 is disposed.

In addition, the developing unit 4 is combined with the photosensitive member unit 13 to be rotatable around a shaft 27 that is fitted into a fitting hole 19*a* disposed in an arm 19 as its center. When an image is formed by the cartridge 7, the developing unit 4 is urged by a compression spring 28 and is rotated around the shaft 27 as its center, whereby the development roller 17 is brought into contact with the photosensitive drum 1.

Figure 3A:
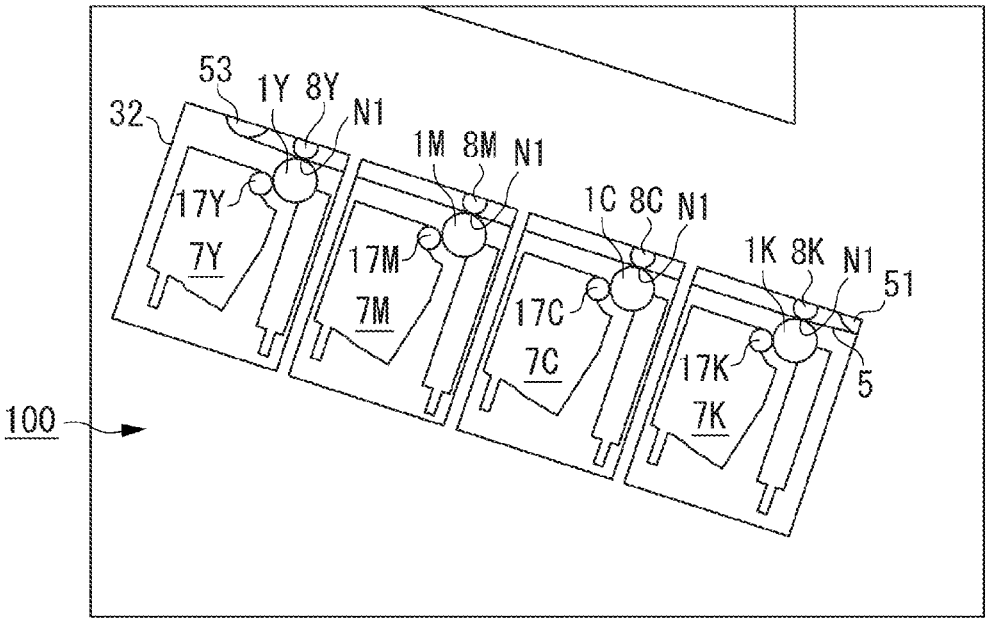
FIGS. 3A and 3B are schematic diagrams illustrating a method of replacing a process cartridge.
Figure 3B:
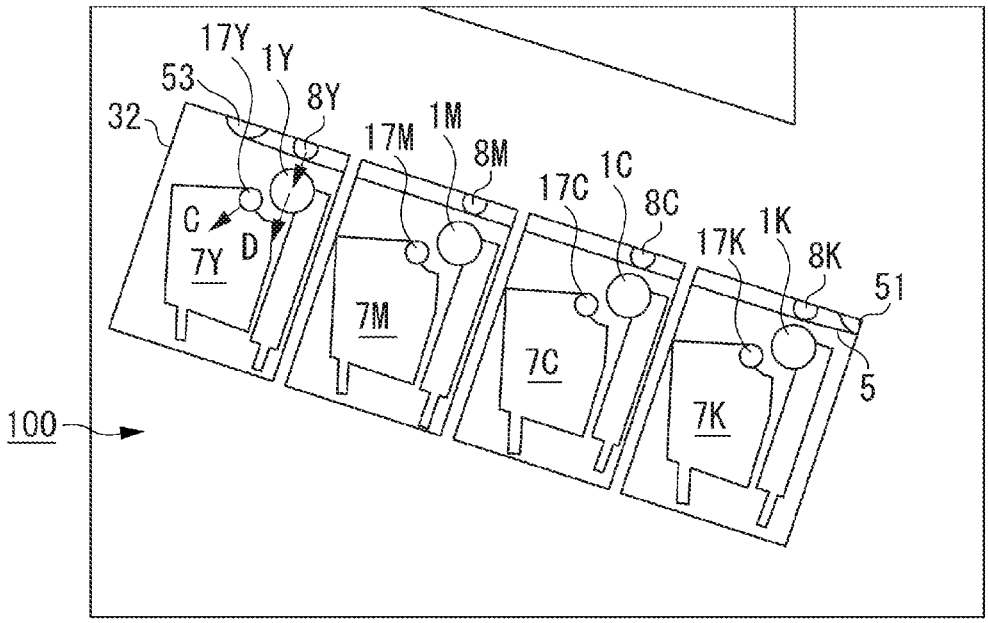
Figure 4:
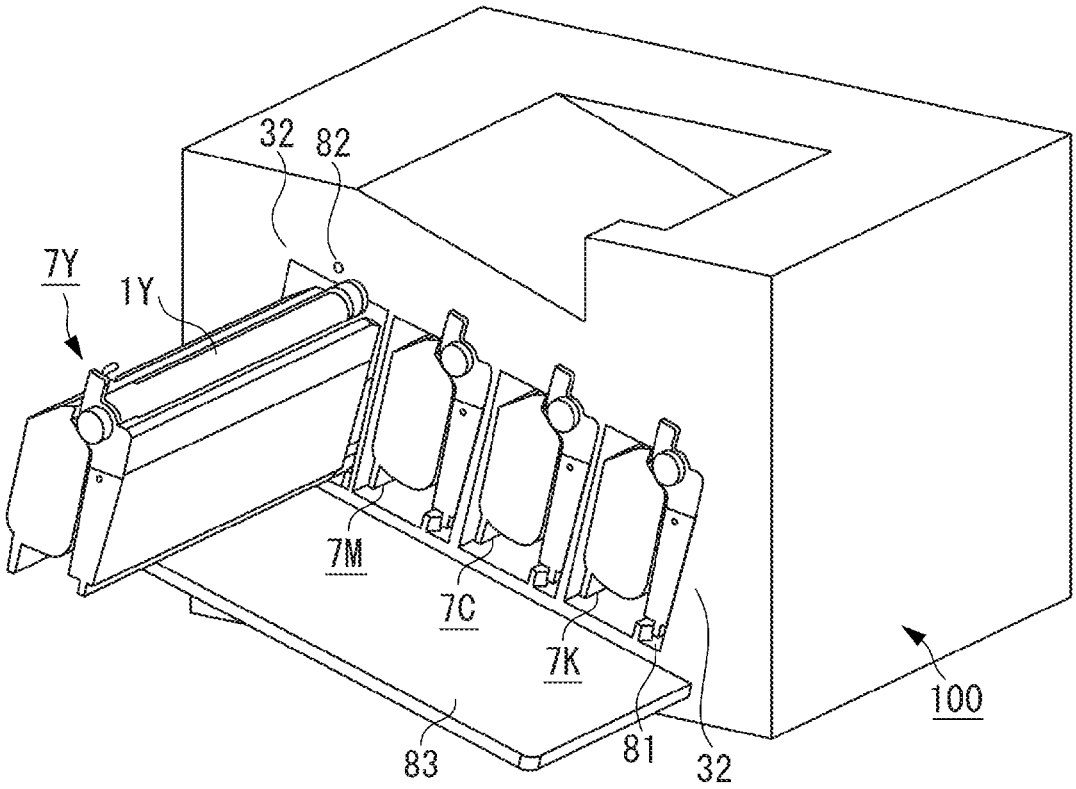
FIG. 4 is a schematic cross-sectional view of an image forming apparatus.

A method of replacing the cartridge according to the present exemplary embodiment will be described with reference to FIGS. 3A, 3B, 4, 13, 14A, 14B, 14C, and 15. FIG. 3A illustrates a state at the time of image formation. FIG. 3B is a schematic cross-sectional view of the image forming apparatus 100 that is in a state at the time of no image formation, and FIG. 4 is a perspective view illustrating a state in which each cartridge 7 is replaced in the main assembly 100A. In addition, FIGS. 13, 14A, 14B, 14C, and 15 are schematic diagrams illustrating the states at the time of mounting the cartridge 7 in the main assembly 100A and at a time when the cartridge 7 has been mounted in the main assembly 100A.

In the image forming apparatus 100 according to the present exemplary embodiment, for the replacement of each cartridge 7, a method is used in which a front door 83 that is an opening/closing member disposed in the main assembly 100A is open and an access is made from the front.

In the center portion of the main assembly 100A, a cartridge housing unit 32 that houses the cartridges 7 is disposed. On the lower side of the cartridge housing unit 32 of the image forming apparatus 100, a guide portion 81 that is used for supporting each cartridge is disposed. In addition, on the upper side of the cartridges 7, as described above, the intermediate transfer belt 5 that is formed by an endless-shaped belt as an intermediate transfer member, the driving roller 51, the driven roller 53, and the primary transfer roller 8 are arranged. When an image is formed, the primary transfer roller 8, as illustrated in FIG. 3A, presses the intermediate transfer belt 5 toward the photosensitive drum 1 and forms a nip (primary transfer nip) at the primary transfer portion N1 at which the intermediate transfer belt 5 and the photosensitive drum 1 are brought into contact with each other.

Figure 13:
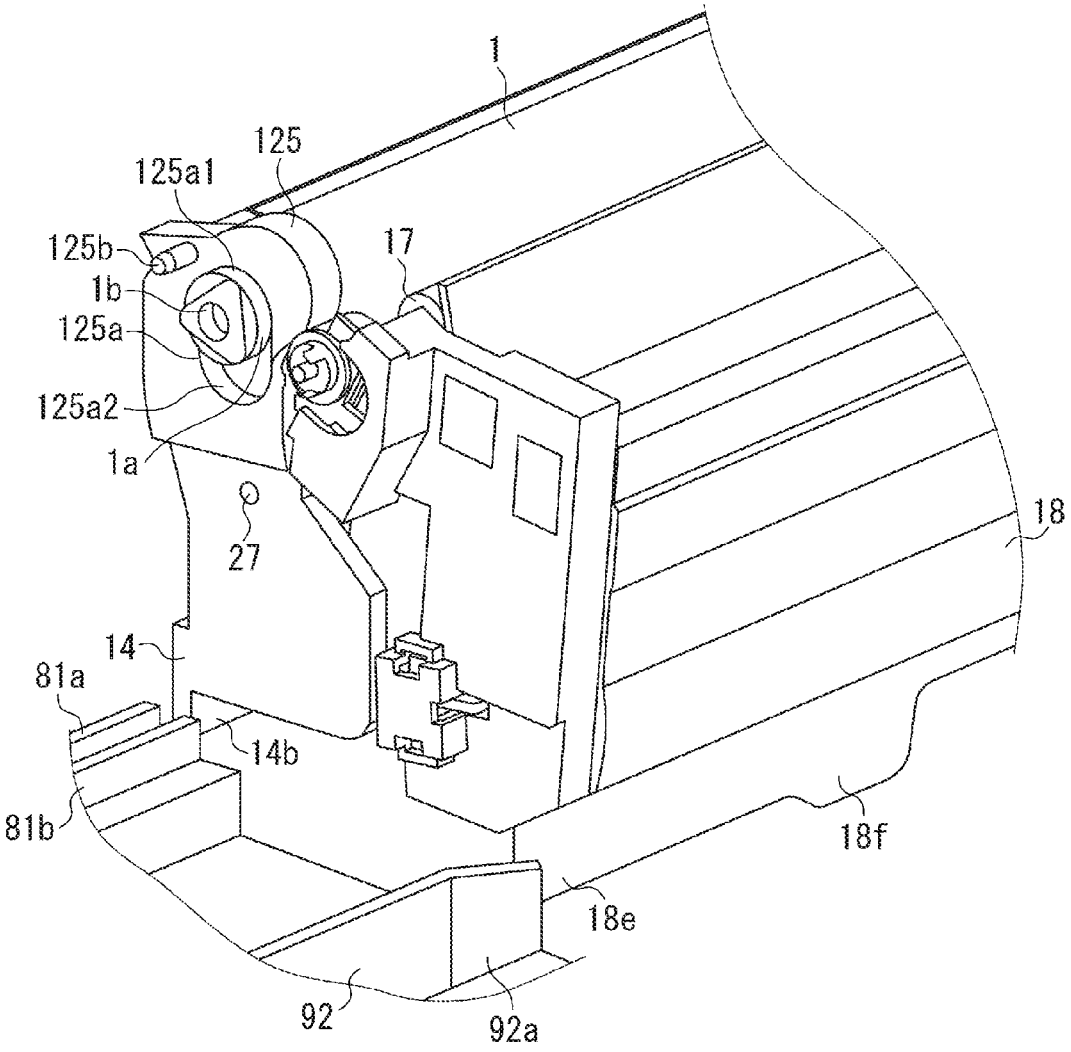
FIG. 13 is a schematic diagram illustrating the mounting the process cartridge in an image forming main assembly.

As illustrated in FIGS. 3A, 3B, 14A, 14B, and 14C, in the main assembly 100A, a mounting opening portion 32 that is used for mounting each cartridge 7 is disposed. In addition, as illustrated in FIG. 13, in the main assembly 100A, a separation guiding unit 92 that is brought into contact with a protruded portion 18*e* disposed in the developing unit 18 of the cartridge 7 is disposed. In the protruded portion 18*e*, a force receiving portion 18*f* that receives a force from a separation member 9 that is disposed in the main assembly 100A for separating the developing roller 17 from the photosensitive drum 1 is integrally formed.

Figure 14A:
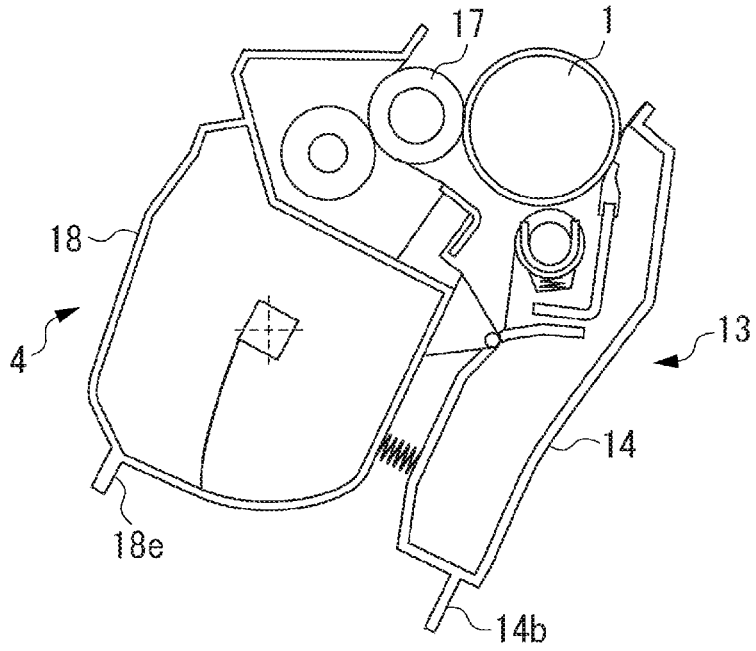
FIGS. 14A, 14B, and 14C are schematic diagrams illustrating the mounting of the process cartridge in the image forming main assembly.
Figure 14B:
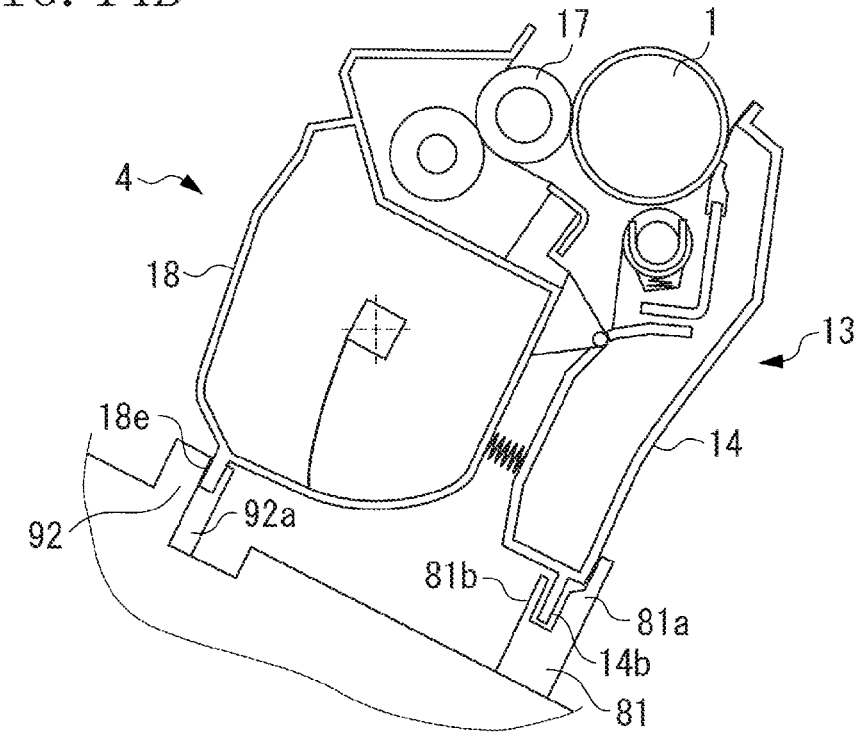
Figure 14C:
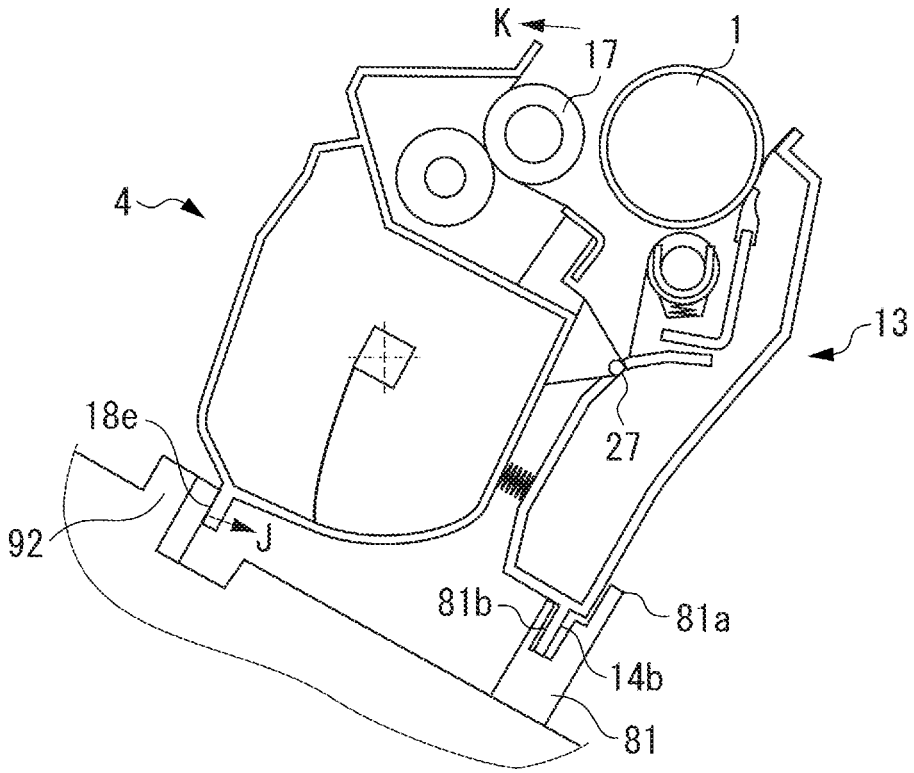

As illustrated in FIG. 14A, before the cartridge 7 enters the main assembly 100A, the developing unit 4 is located at a contact position (development position), and the photosensitive drum 1 and the developing roller 25 are brought into contact with each other. As illustrated in FIG. 14B, when the cartridge 7 is mounted in the main assembly 100A, first, a guide portion 14*b* that is integrally disposed in the cleaning frame 14 is guided to the main body guiding member 81 disposed in the main assembly 100A. Then, the protruded portion 18*e* disposed in the development frame 18 is brought into contact with a chamfer portion 92*a* of the separation guiding unit 92. Thereafter, when the cartridge 7 further enters the main assembly 100A, as illustrated in FIG. 14C, the developing unit 4 rotates around the shaft 27 as its center in the direction of arrow J. Then, the developing unit 4 retreats from the contact position and moves to a separation position (non-development position) denoted by arrow K, and the development roller 17 is separated from the photosensitive drum 1. This operation is performed until the photosensitive drum 1 is located on the lower side of the intermediate transfer belt 5 in a mounting direction in which the cartridge 7 is mounted in the main assembly 100A.

Figure 6A:
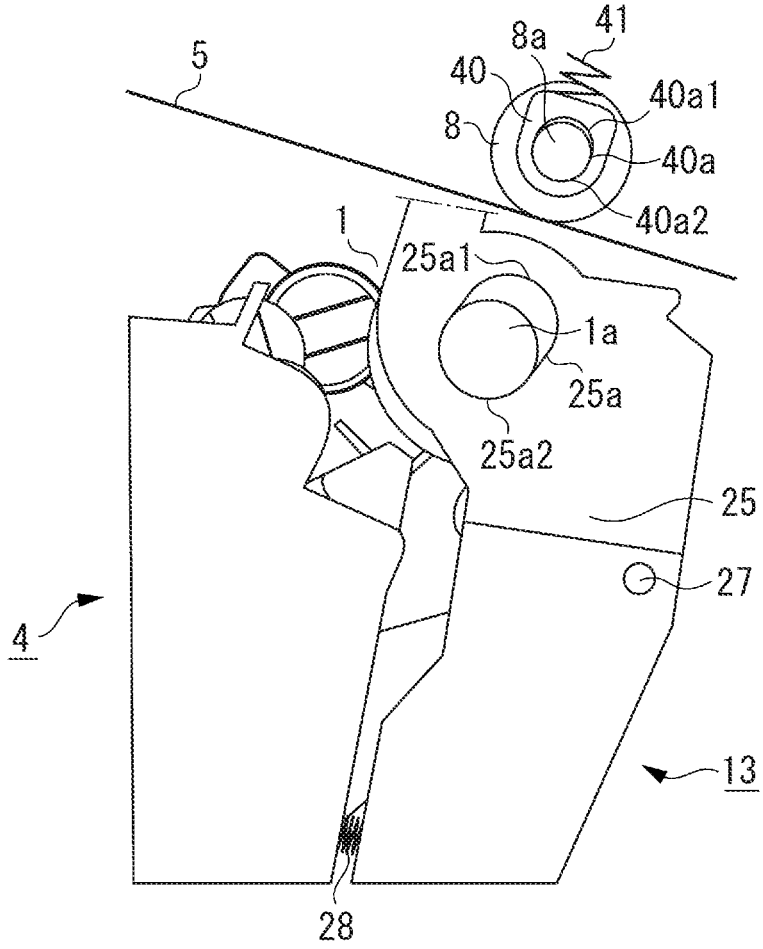
FIGS. 6A and 6B are schematic diagrams illustrating a method of determining a drum position in a non-image forming state of the process cartridge.
Figure 6B:
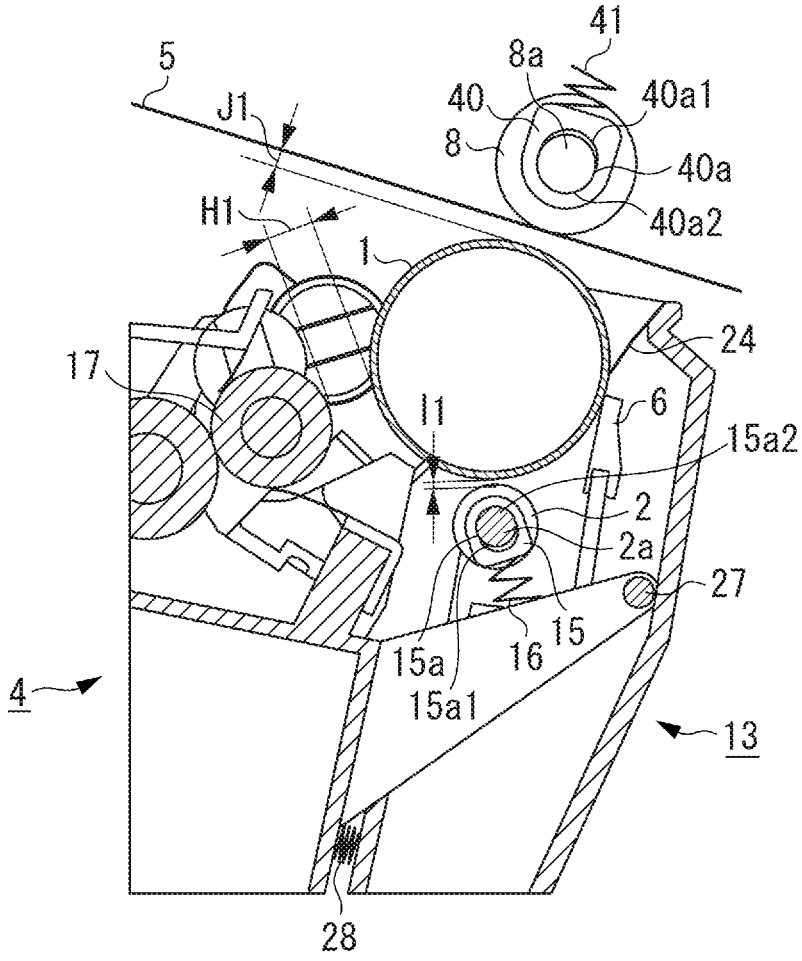
Figure 15:
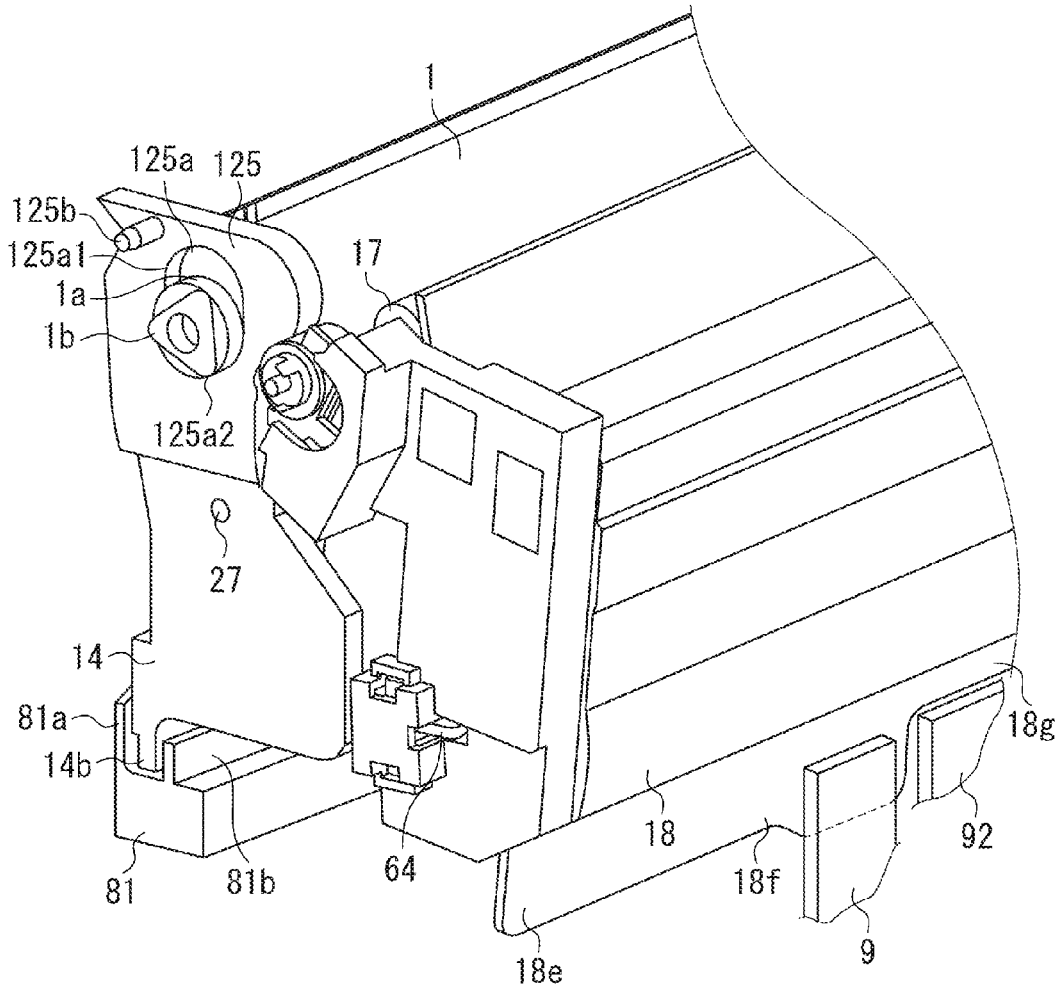
FIG. 15 is a schematic diagram illustrating a state in which the process cartridge is mounted in the image forming main assembly.

In other words, when a state is formed in which the developing roller 17 is separated from the photosensitive drum 1, as illustrated in FIGS. 6A, 6B, and 15, the photosensitive drum 1 is moved to the lower side of bearing holes 25*a* and 125*a* each having a elongate hole shape as support portions and has a clearance gap J1 from the intermediate transfer belt 5. In such a state, when the cartridge 7 is mounted in the main assembly 100A in the direction of the axis line of the photosensitive drum 1, the photosensitive drum 1 and the intermediate transfer belt 5 do not rub each other. Then, when the cartridge 7 is positioned in the main assembly 100A, as illustrated in FIG. 15, a state is formed in which the force receiving portion 18*f* is brought into contact with the separation member 9 that is arranged on the downstream side of the separation guiding unit 92 in the mounting direction. At that time, the developing unit 4 is located at the separation position, and the cartridge 7 can be mounted in the main assembly 100A while maintaining the state in which the development roller 17 is separated from the photosensitive drum 1.

Figure 9A:
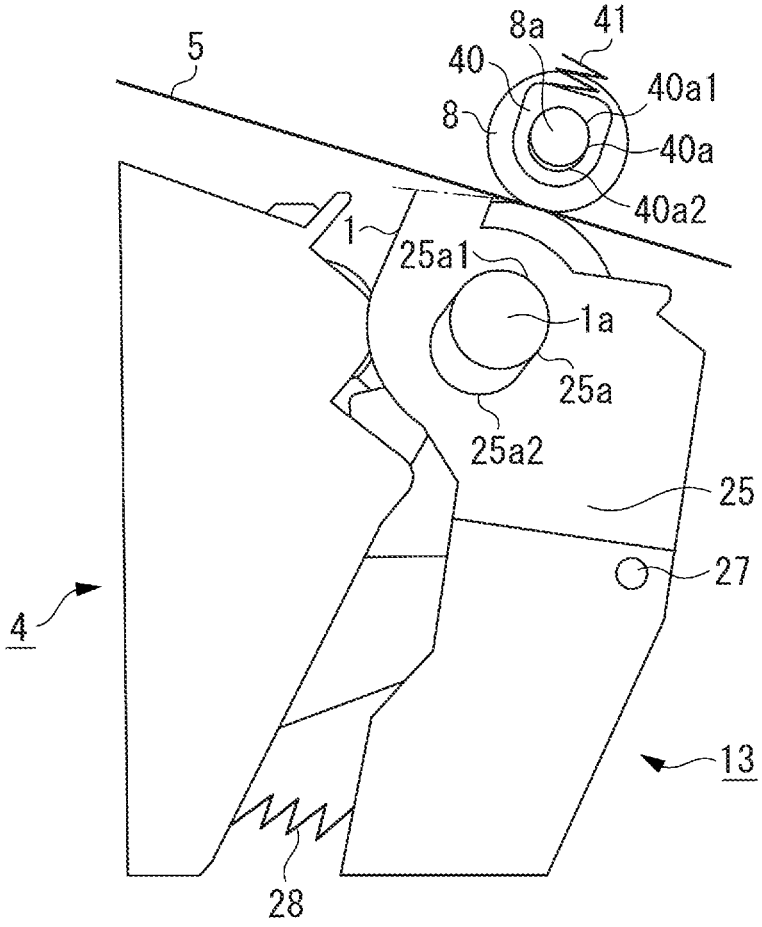
FIGS. 9A and 9B are diagrams illustrating a method of determining the drum position in the image forming state of the process cartridge.
Figure 9B:
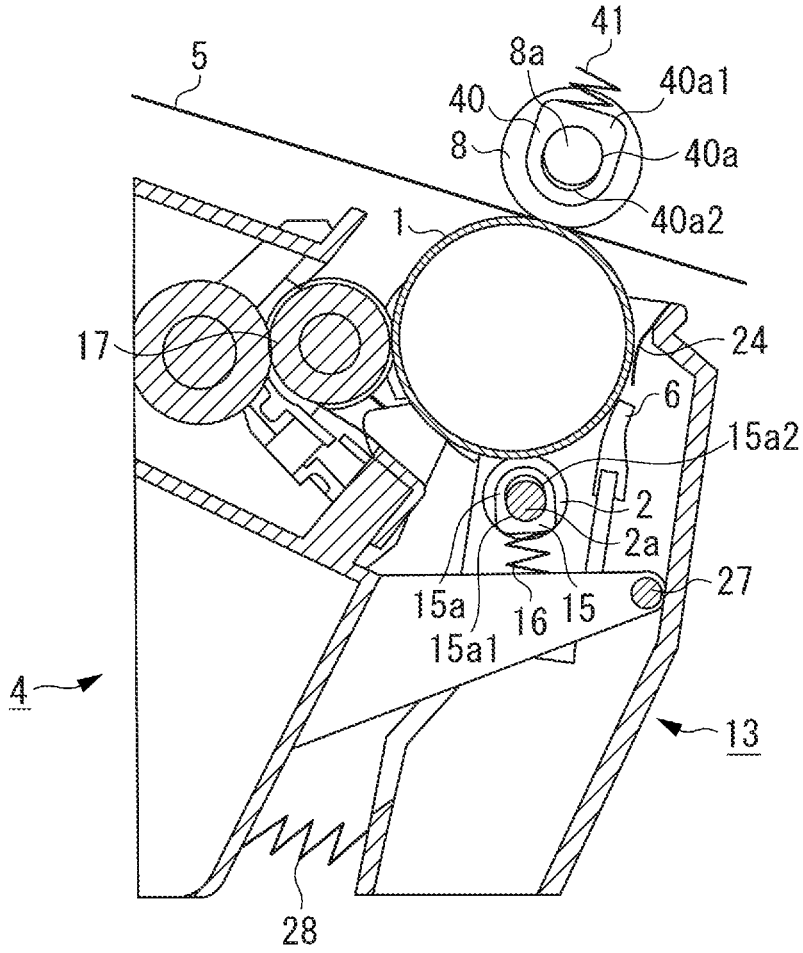

In such a case, a force receiving run-off portion 18*g* that is disposed on the upstream side of the force receiving portion 18*f* in the mounting direction of the cartridge 7 has a shape not interfering with the mounting guiding unit 92. This is for allowing the developing unit 4 to move to the contact position without interfering with the separation guiding unit 92. Then, when an image is formed, as illustrated in FIGS. 9A and 9B, as the separation member 9 is separated away from the force receiving portion 18*f*, the development roller 25 and the photosensitive drum 1 are in the state of being brought into contact with each other by a pushing member 28.

When the image forming state illustrated in FIG. 3A ends, the development roller 17 is moved again in the direction of arrow C illustrated in FIG. 3B to be separated from the photosensitive drum 1 by the separation member 9 (see FIG. 15) disposed in the main assembly 100A. At that time, since the photosensitive drum 1 is not pressed by the development roller 17, the photosensitive drum 1 is simultaneously moved in the direction of arrow D. The amount of movement of the photosensitive drum 1 is regulated by the drum bearings 25 and 125 (see FIGS. 5A, 5B, 5C, and 15), and the photosensitive drum 1 is stopped at a position not being brought into contact with the development roller 17. On the other hand, the primary transfer roller 8 is moved in the direction of arrow E according to the movement of the photosensitive drum 1 as a pressing target. The amount of movement of the primary transfer roller 8 is regulated by a primary transfer roller bearing 40 (see FIGS. 6A and 6B), and the primary transfer roller 8 is stopped at a position not being brought into contact with the photosensitive drum 1. In other words, in this state in which image formation is completed, the photosensitive drum 1 is not brought into contact with both the development roller 17 and the primary transfer roller 8. Since the cartridge 7 is taken out in this state, the intermediate transfer belt 5 and the photosensitive drum 1 do not rub each other.

Accordingly, a configuration may not be employed in which the cartridge 7 is lifted to position the cartridge 7 in the main assembly 100A when the attachment/detachment of the cartridge 7 is performed. In addition, at a position of the cartridge 7 at which the positioning thereof is determined, it is possible to directly insert the cartridge 7 in the direction of the axis line of the photosensitive drum 1. Specifically, when the cartridge 7 is mounted in the main assembly 100A, positioning protrusions 25*b* (see FIGS. 4, 5A, 5B, and 5C) and 125*b* (see FIGS. 11A, 11B, 11C, and 11D) that are disposed in the bearing 25 are fitted into positioning holes 82 (see FIGS. 4) and 182 (see FIGS. 10A and 10B) disposed in the main assembly 100A. Then, a diving force is transmitted to the photosensitive drum 1 by a driving transfer member 48 to be described below, whereby the cartridge 7 receives clockwise rotational moment in FIG. 2. A protrusion 14*b* disposed in the cleaning frame 14 is brought into contact with a guide 81*a*. Accordingly, the cartridge 7 is positioned in a radial direction thereof with respect to the main assembly 100A.

Next, the configuration employed for regulating the position of the photosensitive drum 1 in the present exemplary embodiment will be described with reference to FIG. 5A to FIG. 10B and FIGS. 12A to FIG. 15.

Figure 5A:
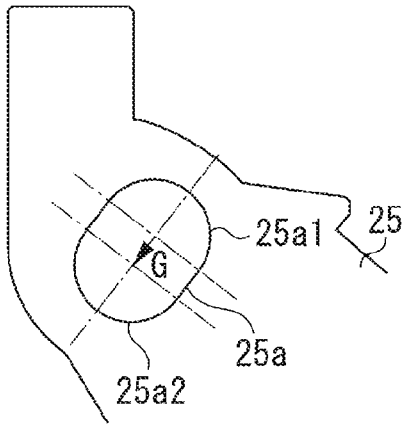
FIGS. 5A, 5B, and 5C are schematic diagrams illustrating a photosensitive drum position regulating mechanism.
Figure 5B:
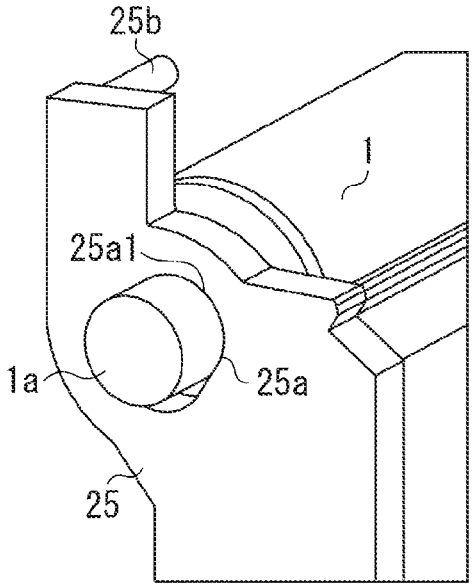
Figure 5C:
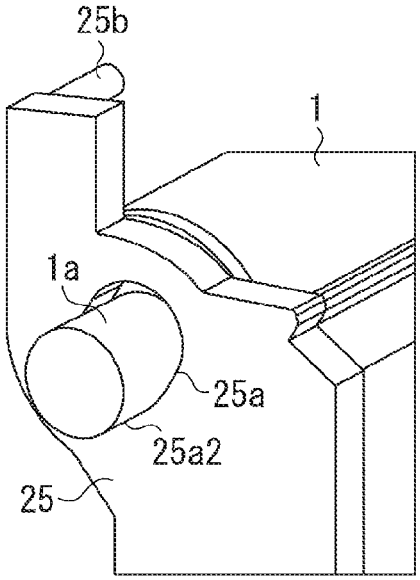

First, the basic configuration of components that are used for positioning the photosensitive drum 1 will be described with reference to FIGS. 5A to 5C. FIGS. 5A illustrates the drum bearing 25, and FIGS. 5B and 5C are schematic diagrams illustrating states in which the photosensitive drum 1 is installed to the drum bearing 25. FIG. 5B illustrates a state at the time of image formation, and FIG. 5C illustrates a state at the time of no image formation.

The photosensitive drum 1 has a drum shaft 1*a* located in both end portions thereof being supported by the drum bearings 25 and 125 to be rotatable. In the drum bearings 25 and 125, bearing holes 25*a* and 125*a* having a long round shape extending in the direction of arrow G are formed. These are for allowing the photosensitive drum 1 to be pressed by the developing roller 17 or the like to be movable between an acting position that is the state at the time of image formation and a non-acting position, at which the pressing force applied to the photosensitive drum 1 is released, that is the state at the time of non-image formation. In addition, in the present exemplary embodiment, the acting position of the photosensitive drum 1 represents a position at a time when an image forming operation is performed, and the non-acting position of the photosensitive drum 1 represents a position at a time when the image forming operation is not performed. At the acting position, as illustrated in FIGS. 5B and 13, first positioning portions 25*a*1 and 125*a*1 disposed on the upper side of the bearing holes 25*a* and 125*a* and the drum shaft 1*a* are brought into contact with each other to determine the position of the photosensitive drum 1. On the other hand, at the non-acting position, as illustrated in FIGS. 5C and 15, second positioning portions 25*a*2 and 125*a*2 disposed on the lower side of the bearings 25 and 125 and the drum shaft 1*a* are configured to be brought into contact with each other to determine the position of the photosensitive drum 1.

Figure 7A:
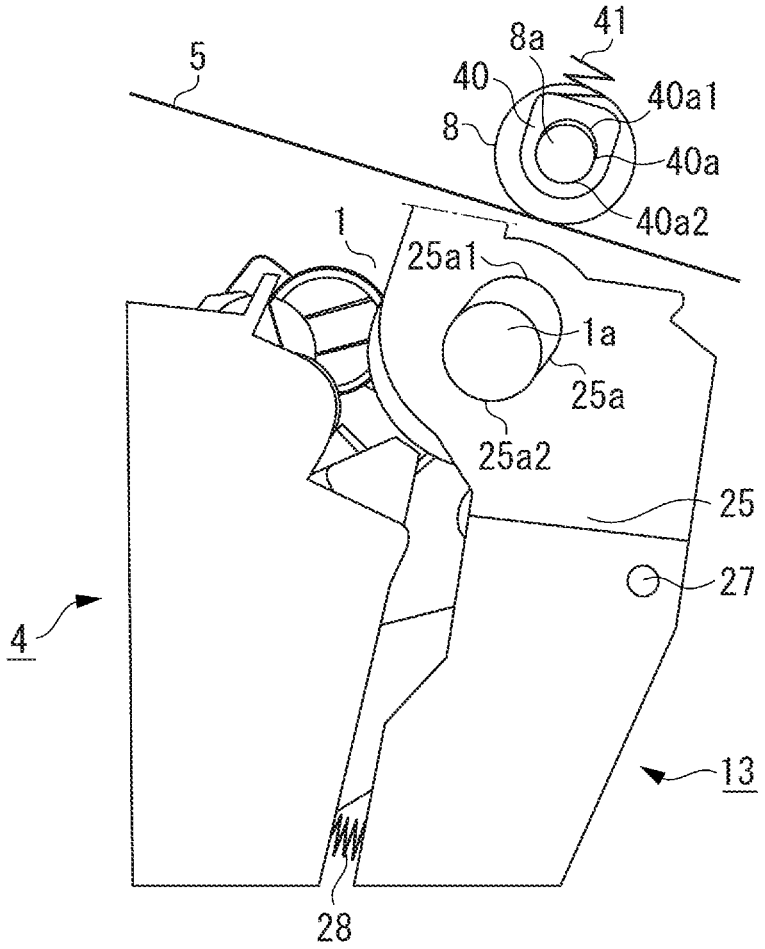
FIGS. 7A and 7B are schematic diagrams illustrating a method of regulating and determining the drum position in the middle of a transition "1" between a non-image forming state and an image forming state of the process cartridge.
Figure 7B:
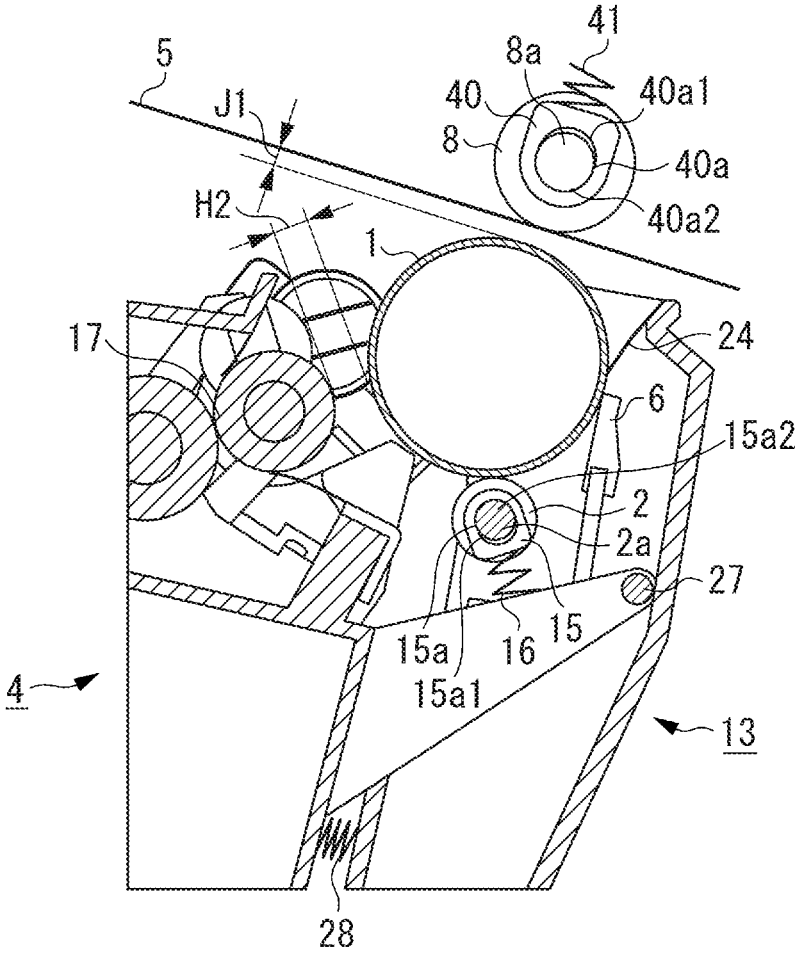
Figure 8A:
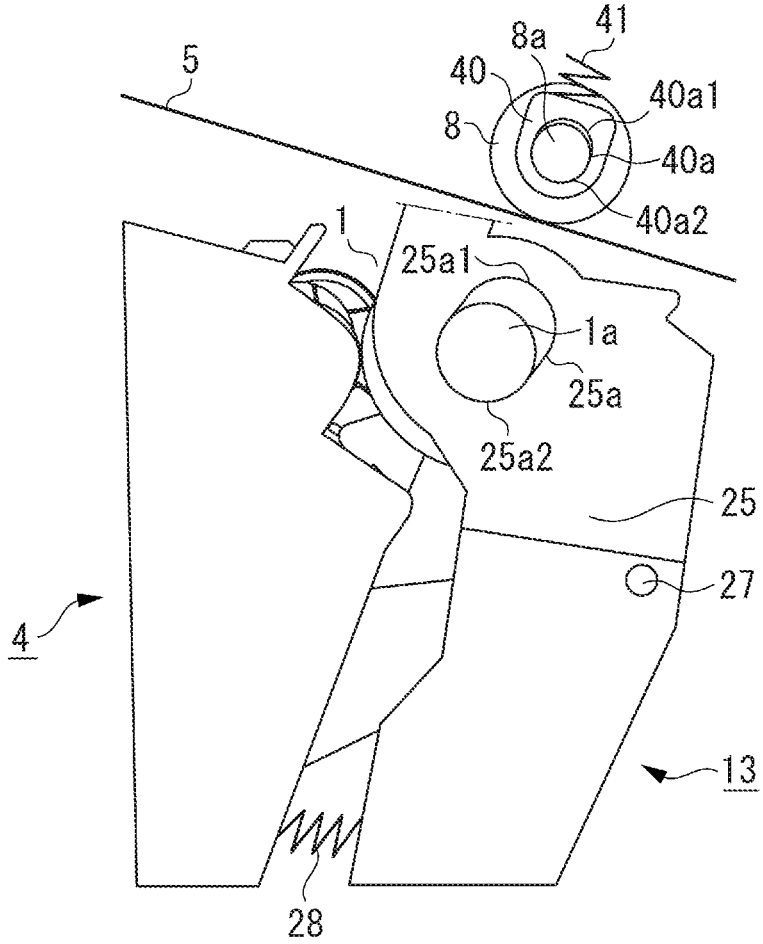
FIGS. 8A and 8B are schematic diagrams illustrating a method of regulating and determining the drum position in the middle of a transition "2" between the non-image forming state and the image forming state of the process cartridge.
Figure 8B:
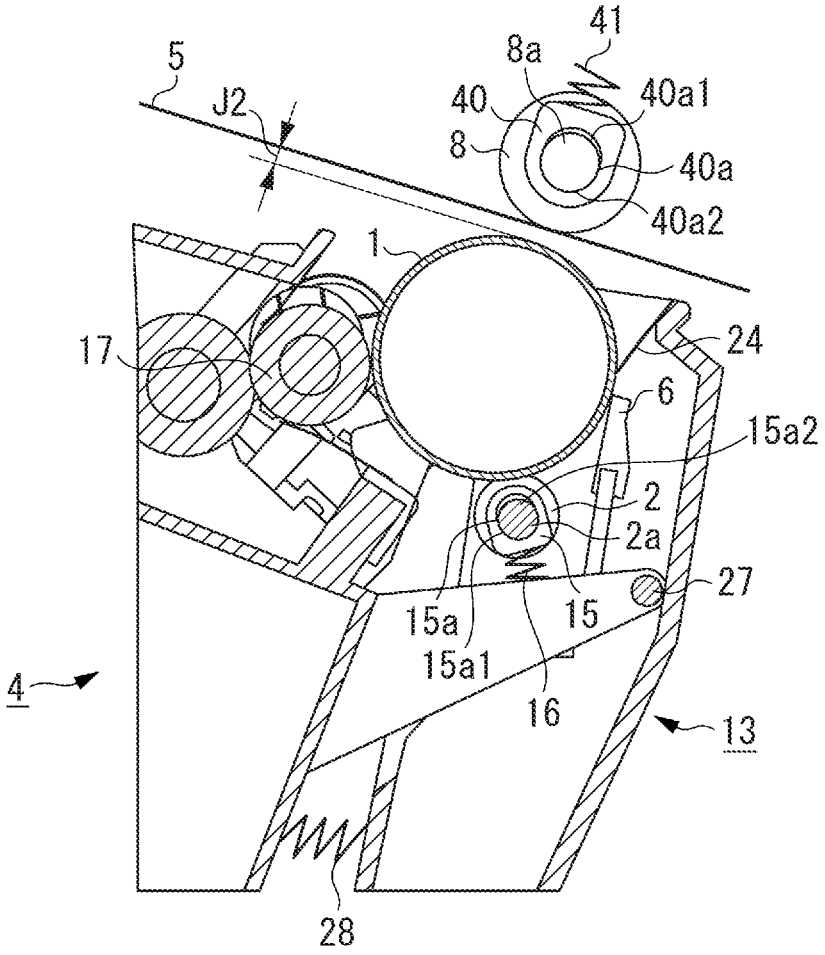

Next, a method of positioning the photosensitive drum 1 after the mounting of the cartridge 7 in the main assembly 100A will be described with reference to FIGS. 6A to 9B. FIGS. 6A and 6B illustrate a non-image forming state, and FIGS. 7A and 7B illustrate a state in the middle of a transition from the non-image forming state to an image forming state. FIGS. 8A and 8B illustrate a state in which the transition is further made from the state illustrated in FIGS. 7A and 7B toward the image forming state, and FIGS. 9A and 9B are schematic diagrams illustrating a mechanism for positioning the photosensitive drum 1 in the image forming state. Each diagram A is a schematic diagram illustrating the positioning of the photosensitive drum 1, and each diagram B is a diagram illustrating the positional relation between the photosensitive drum 1 and the pushing member.

First, the non-image forming state will be described with reference to FIGS. 6A and 6B. In the non-image forming state, as illustrated in FIG. 6A, the drum shaft 1*a* of the photosensitive drum 1 is brought into contact with the second positioning portion 25*a*2 of the drum bearing 25 such that the photosensitive drum 1 secures a non-acting position, whereby the position is determined.

Next, a configuration will be described with reference to FIG. 6B in which the photosensitive drum 1 is fixed to a non-acting position. FIG. 6B is a cross-sectional view of FIG. 6A.

In the non-image forming state, the developing unit 4 is rotated around the shaft 27 at its center by the separation member (see FIG. 15) arranged in the image forming apparatus such that the development roller 17 is separated from the photosensitive drum 1 by a length H1.

According to the rotation of the developing unit 4, the charging roller 2 arranged in the developing unit 4 is also rotated to be separated from the photosensitive drum 1 by a length I1. At this time, the charging roller bearing 15 is positioned in the developing unit 4 by a charging stopper (not illustrated in the figure). The charging roller shaft 2*a* and a third positioning portion 15*a*2 of a charging roller regulating groove 15*a* disposed in the charging roller bearing 15 are brought into contact with each other, whereby the charging roller 2 is positioned.

At this time, the photosensitive drum 1 is moved to a non-acting position as illustrated in FIG. 6A according to the separation of the development roller 17 and the charging roller 2. According to the movement of the photosensitive drum 1, a pressing force of the cleaning blade 6 and the toner sealing member 24 which are pressing the photosensitive drum 1 are decreased. In this state, although the cleaning blade 6 and the toner sealing member 24 are brought into contact with the photosensitive drum 1, a state is formed in which a pressing force that is much smaller than that at the time of image formation remains. The photosensitive drum 1 is maintained at the non-acting position based on the remaining pressing force and one's own weight.

In addition, according to the movement of the photosensitive drum 1, the primary transfer roller 8 of the intermediate transfer member 5 is separated from the photosensitive drum 1 by a length J1. At this time, the primary transfer roller bearing 40 is positioned in the intermediate transfer member 5 by a primary transfer stopper (not illustrated in the figure). The primary transfer roller shaft 8*a* and a fifth positioning portion 40*a*2 of the primary transfer roller regulating groove 40*a* disposed in the primary transfer roller bearing 40 are brought into contact with each other, whereby the primary transfer roller 8 can be positioned.

Furthermore, the positional relation between the photosensitive drum 1 and the charging roller 2 and the primary transfer roller 8 is not necessarily separated from each other as long as the pressing force is smaller than that of the pressing state.

Next, the state in the middle of a transition from the non-image forming state to the image forming state will be described with reference to FIGS. 7A and 7B.

In the state in the middle of the transition from the non-image forming state to the image forming state, as illustrated in FIG. 7A, the drum shaft 1*a* of the photosensitive drum 1 is brought into contact with the second positioning portion 25*a*2 of the drum bearing 25 such that the photosensitive drum 1 secures a non-acting position, whereby the position is determined.

Next, the configuration will be described with reference to FIG. 7B in which the photosensitive drum 1 is fixed to a non-acting position. FIG. 7B is a cross-sectional view of FIG. 7A. In the state in the middle of the transition from the non-image forming state to the image forming state, with respect to the state illustrated in FIG. 6B, the developing unit 4 is rotated around the shaft 27 as its center by the separation member (see FIG. 15) arranged in the image forming apparatus. Then, the development roller 17 approaches the photosensitive drum 1 to be in a state of being separated therefrom by a length H2 (H2<H1). At that time, the charging roller 2 disposed in the arm 19 is moved to form a state in which the photosensitive drum 1 and the charging roller 2 are brought into contact with each other. At this time, similarly to the case illustrated in FIG. 6B, the charging roller bearing 15 is positioned in the developing unit 4 by the charging stopper (not illustrated in the figure). The charging roller shaft 2*a* and the third positioning portion 15*a*2 of the charging roller regulating groove 15*a* disposed in the charging roller bearing 15 are brought into contact with each other, whereby the charging roller 2 is positioned.

At this time, although the charging roller 2 is brought into contact with the photosensitive drum 1, the position of the charging roller 2 is determined by the charging stopper (not illustrated in the figure). Accordingly, a pressing force for the photosensitive drum 1 is not generated, and the photosensitive drum 1, similarly to the case illustrated in FIG. 6A, maintains the non-acting position as illustrated in FIG. 7A. Since the photosensitive drum 1 is maintained at the non-acting position, the cleaning blade 6 and the toner sealing member 24 are in a state in which a pressing force much smaller than that at the time of image formation remains.

In addition, as illustrated in FIG. 7B, the position of the primary transfer roller 8 is maintained to be in a state of being separated from the photosensitive drum 1 by the length J1.

Next, a state will be described with reference to FIGS. 8A and 8B in which the transition is further made from the state illustrated in FIGS. 7A and 7B toward the image forming state In the state in which the transition is further made from the state illustrated in FIGS. 7A and 7B toward the image forming state, as illustrated in FIG. 8A, the drum shaft 1*a* of the photosensitive drum 1 is brought into contact with the second positioning portion 25*a*2 of the drum bearing 25 such that the photosensitive drum 1 secures a non-acting position, whereby the position is determined.

Next, the configuration will be described with reference to FIG. 8B in which the photosensitive drum 1 is fixed to a non-acting position. FIG. 8B is a cross-sectional view of FIG. 8A.

In the state in which the transition is further made from the state illustrated in FIGS. 7A and 7B toward the image forming state, with respect to the state illustrated in FIG. 7B, the developing unit 4 is further rotated around a fitting axis 27 as its center by the separation member (see FIG. 15) arranged in the image forming apparatus, and a state is formed in which the developing roller 17 is brought into contact with the photosensitive drum 1.

Simultaneously, although the charging roller 2 is also pressed to the photosensitive drum 1, as illustrated in FIG. 7B, a state is formed in which the charging roller 2 has already been brought into contact with the photosensitive drum 1, and accordingly, the charging roller pressing member 16 is sagged, whereby the charging roller 2 is continuously brought into contact with the photosensitive drum 1 in a state in which the charging roller bearing 15 and the charging stopper (not illustrated in the figure) are separated. In addition, since the charging roller 2 receives the pressing force of the charging roller pressing member 16 through the charging roller bearing 15, the charging roller shaft 2*a* and a fourth positioning portion 15*a*1 of the charging roller regulating groove 15*a* disposed in the charging roller bearing 15 are brought into contact with each other, whereby the position is determined.

At this time, although the charging roller 2 is brought into contact with the photosensitive drum 1 to generate a pressing force, the pressing force of the charging roller pressing member 16 is smaller than the pressing force of the cleaning blade 6. Accordingly, the photosensitive drum 1, similarly to the case illustrated in FIGS. 6A and 7A, maintains a non-acting position as illustrated in FIG. 8A. Since the photosensitive drum 1 is maintained at the non-acting position, the cleaning blade 6 and the toner sealing member 24 are in a state in which pressing forces much smaller than that at the time of image formation remains.

In addition, similarly, the position of the primary transfer roller 8 is maintained to be in a state in which the primary transfer roller 8 is separated from the photosensitive drum 1 by the length J2.

Next, the image forming state will be described with reference to FIGS. 9A and 9B.

In the image forming state, as illustrated in FIG. 9A, the drum shaft 1*a* of the photosensitive drum 1 is brought into contact with a first positioning portion 25*a*1 of the drum bearing 25 such that the photosensitive drum 1 secures an acting position, whereby the position is determined.

Next, a configuration will be described with reference to FIG. 9B in which the photosensitive drum 1 is fixed to an acting position. FIG. 9B is a cross-sectional view of FIG. 9A.

In the image forming state, with respect to the state illustrated in FIG. 8B, the separation member (see FIG. 15) arranged in the image forming apparatus is separated from the developing unit 4, the developing unit 4 is further rotated around the fitting axis 27 as its center by the compression spring 28, and a state is formed in which the developing roller 17 presses the photosensitive drum 1.

Simultaneously, the charging roller 2, similarly to the case illustrated in FIG. 8B, is in the state of pressing the photosensitive drum 1 based on the pressing force of the charging roller pressing member 16 while being brought into contact with the photosensitive drum 1. At this time, similarly to the case illustrated in FIG. 8B, the charging roller shaft 2*a* and the fourth positioning portion 15*a*1 of the charging roller regulating groove 15*a* disposed in the charging roller bearing 15 are brought into contact with each other, whereby the charging roller 16 determines the position.

According to the movement of the photosensitive drum 1 to the acting position, the primary transfer roller 8 is brought into contact with the photosensitive drum 1, the primary transfer roller pressing member 41 is sagged, and the primary transfer roller bearing 40 and the primary transfer roller stopper (not illustrated in the figure) are separated from each other and moved in the direction of arrow K. At this time, the primary transfer roller bearing 40 is pressed by the primary transfer roller pressing member 41 disposed in the intermediate transfer member 5, and a state is formed in which the photosensitive drum 1 is pressed according to the pressing force. At this time, the primary transfer roller 8 receives the pressing force of the primary transfer roller pressing member 41 through the primary transfer roller bearing 40. Accordingly, the primary transfer roller shaft 8*a* and a sixth positioning portion 40*a*1 of the primary transfer roller regulating groove 40*a* disposed in the primary transfer roller bearing 40 are brought into contact with each other, whereby the position is determined.

The pressing force of the cleaning blade 6 and the toner sealing member 24 toward the photosensitive drum 1 is set to be smaller than the pressing force of the compression spring 28 and the charging roller pressing member 16. Accordingly, with respect to the states illustrated in FIGS. 6B, 7B, and 8B, a sagged state is formed to increase the pressing force. In this state, the cleaning blade 6 applies a pressing force satisfying the cleaning capability to the photosensitive drum 1, whereby an image forming state is formed.

Figure 10A:
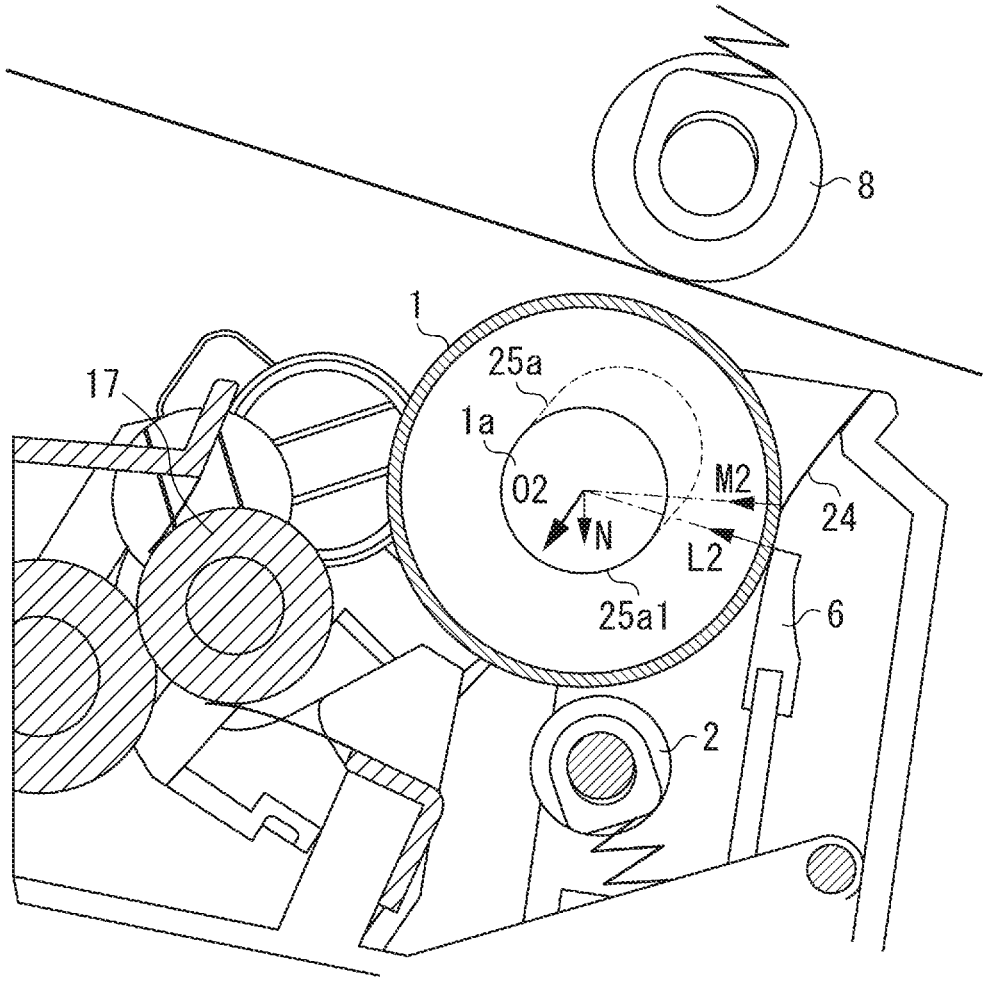
FIGS. 10A and 10B are schematic diagrams illustrating the load relation relating to the determination of the process cartridge for the drum position.

Next, the relation of the load relating to the positioning of the photosensitive drum 1 at the time of non-image formation and at the time of image formation will be described with reference to FIGS. 10A and 10B. FIG. 10A illustrates the relation of the load with respect to the position of the photosensitive drum 1 at the time of non-image formation, and FIG. 10B illustrates the relation of the load with respect to the position of the photosensitive drum 1 at the time of image formation.

As illustrated in FIG. 10A, at the time of non-image formation, the development roller 17, the charging roller 2, and the primary transfer roller 8 are separated from the photosensitive drum 1. Accordingly, there are three loads, which are applied to the photosensitive drum 1, including a load denoted by arrow L2 that is generated by the cleaning blade 6, a load denoted by arrow M2 that is generated by the toner sealing member 24, and a load denoted by arrow N that is one's own weight of the photosensitive drum 1. The photosensitive drum 1, as illustrated in FIG. 5A, is configured to move only in the direction of arrow G by the bearing hole 25*a* disposed in the drum bearing 25. A G-direction component of a resultant force of the three loads that is denoted by arrow O2 acts such that the drum shaft 1*a* collides with the second positioning portion 25*a*2 of the bearing hole 25*a*, and the position of the photosensitive drum 1 is configured to be determined as the second position.

Figure 10B:
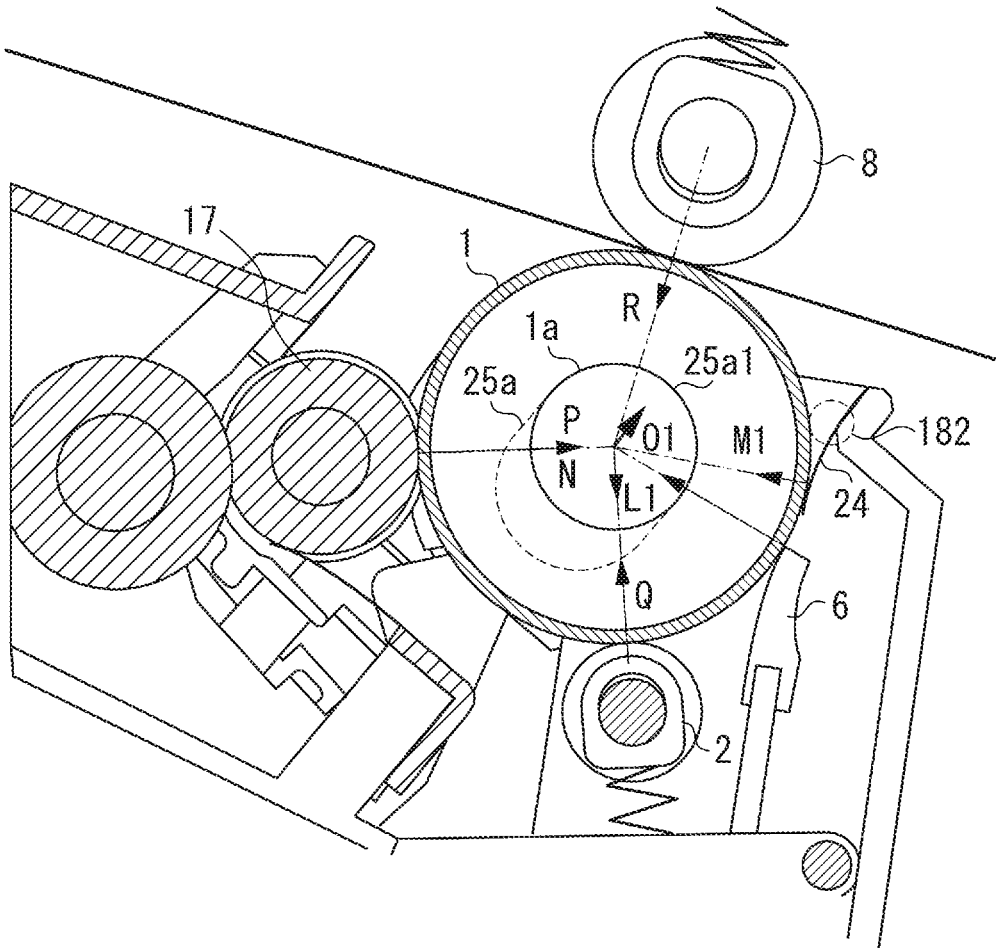

As illustrated in FIG. 10B, at the time of image formation, the developing roller 17, the charging roller 2, and the primary transfer roller 8 are brought into contact with the photosensitive drum 1. Accordingly, the load applied to the photosensitive drum 1 includes a load denoted by arrow L1 that is applied by the cleaning blade 6, a load denoted by arrow M1 that is applied by the toner sealing member 24, a load denoted by arrow N that is applied according to one's own weight of the photosensitive drum 1, a load denoted by arrow P that is applied by the developing roller 17, a load denoted by arrow Q that is applied by the charging roller 2, and a load denoted by arrow R that is applied by the primary transfer roller 8. A G-direction component of a resultant force of the six loads that is denoted by arrow O1 acts such that the drum shaft 1*a* collides with the first positioning portion 25*a*1 of the bearing hole 25*a*, and the position of the photosensitive drum 1 is configured to be determined as the first position.

The drive transmission mechanisms for the photosensitive drum 1 and the developing roller 17 will be described with reference to FIGS. 11A to 12D.

First, the drive transmission mechanism of the photosensitive drum 1 will be described with reference to FIGS. 11A, 11B, 11C, and 11D.

Figure 11A:
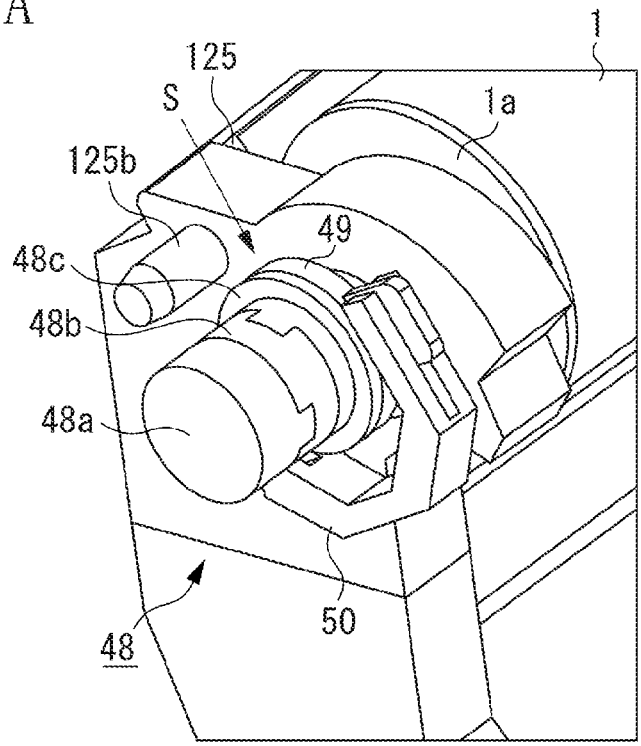
FIGS. 11A, 11B, 11C, and 11D are schematic diagrams illustrating a driving transfer mechanism for a photosensitive drum of the process cartridge.
Figure 11B:
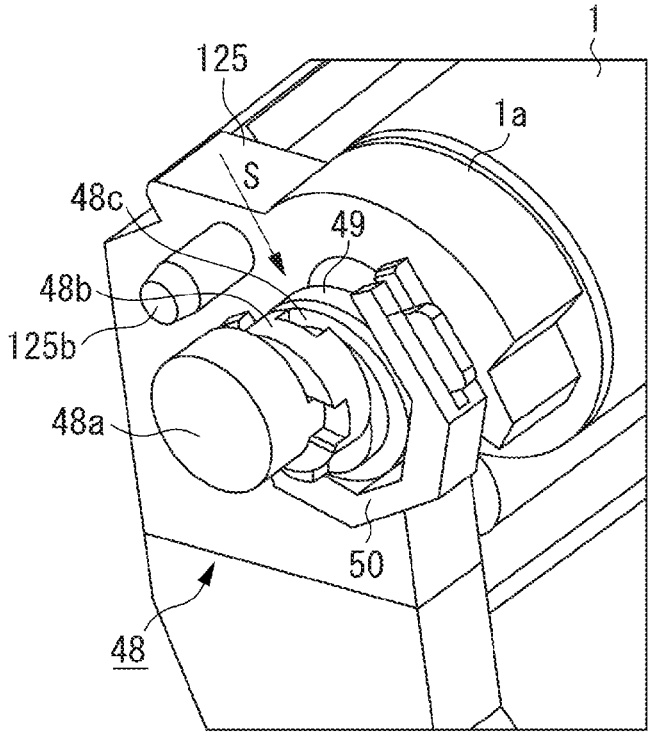
Figure 11C:
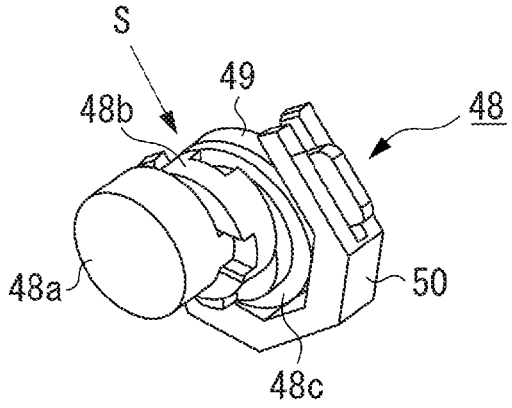

In the present exemplary embodiment, a configuration is employed in which an Oldham's coupling is used as a photosensitive member drive transmission mechanism. FIG. 11A illustrates a drive transmission unit that transmits a driving force to the photosensitive drum 1 at the time of image formation. FIG. 11B illustrates a drive transmission unit that transmits a driving force to the photosensitive drum 1 at the time of non-image formation. In addition, FIG. 11C illustrates the drive transmission unit when the cartridge 7 is detached from the main assembly 100A at the time of non-image formation, and FIG. 11D illustrates the configuration of the photosensitive member Oldham's coupling 48 as a drive transmission member for describing the configuration illustrated in FIG. 11A.

As illustrated in FIG. 11, the photosensitive member Oldham's coupling 48 is configured with a driving portion 48*a*, a intermediate portion 48*b*, and a driven portion 48*c*.

Figure 11D:
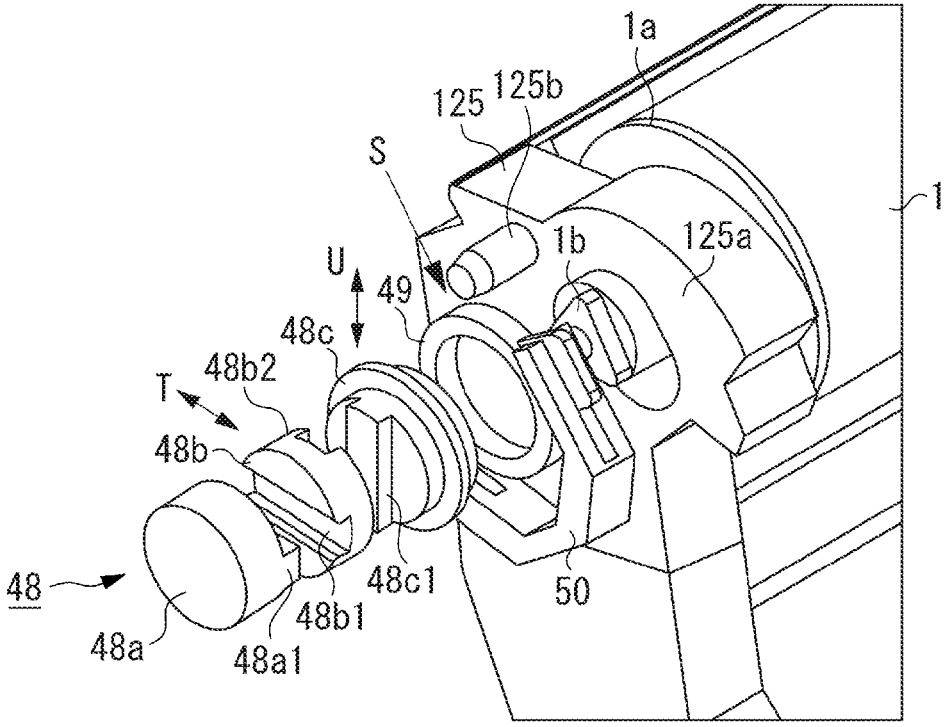

As illustrated in FIGS. 11A and 11D, at the time of image formation, the members of the photosensitive member Oldham's coupling 48 are arranged on the same axis as that of the photosensitive drum 1. The driving portion 48*a* is disposed in the image forming apparatus 100, and a driving force is transmitted to the driving portion 48*a* from a driving source (not illustrated in the figure) as a main body driving member. By fitting a driving rib 48*a*1 disposed in the driving portion 48*a* into a driving groove 48*b*1 disposed in the intermediate portion 48*b*, a driving force is transmitted to the intermediate portion 48*b*. In the intermediate portion 48*b*, a driven groove 48*b*2 is disposed, and, by fitting the driven rib 48*c*1 disposed in the driven portion 48*c* as an engagement portion into the driven groove 48*b*2, a driving force is transmitted to the driven portion 48*c*. The driven portion 48*c* is engaged with a engaging bearing 49 to be rotatable. The engaging bearing 49 receives a load from the urging spring (not illustrated in the figure) in the direction of arrow S. In addition, in the driven portion 48*c*, a driven coupling (not illustrated in the figure) is disposed and is engaged with a drum coupling 1*b* disposed in the drum shaft 1*a* to transmit a driving force to the photosensitive drum 1.

As illustrated in FIG. 11B, at the time of non-image formation, the photosensitive drum 1 is moved to a non-acting position. According to the movement of the photosensitive drum 1, the driven portion 48*c* engaged with the drum coupling 1*b* is moved to have the same axis as that of the photosensitive drum 1. The engaging bearing 49 that is engaged with the photosensitive member driven portion 48 is brought into contact with a bearing positioning portion 50 disposed in the image forming apparatus 100 according to the movement of the photosensitive member driven portion 48. Meanwhile, since the driving portion 48*a* is connected to the image forming apparatus 100, it maintains a position that is the same as the position at the time of image formation. Here, as described above, the intermediate portion 48*b* is configured to be slidable with respect to the driving portion 48*a* in the direction of arrow T and be slidable with respect to the driven portion 48*c* in the direction of arrow U. Accordingly, even when the driven portion 48*c* is moved according to the movement of the photosensitive drum 1, by moving the intermediate portion 48*b* in the direction of arrow U or in the direction of arrow T (illustrated in FIG. 11D), the driving force delivered from the image forming apparatus 100 can be transmitted to the photosensitive drum 1.

As illustrated in FIG. 11C, when the cartridge 7 is taken out from the main assembly 100A at the time of non-image formation, similarly to the case at the time of non-image formation, the driving portion 48*a* is connected to the main assembly 100A, and accordingly, there is no change in position. Meanwhile, since the cartridge 7 is taken out from the main assembly 100A, the engagement of the driven portion 48*c* with the drum coupling 1*b* is released. However, since the engaging bearing 49 engaged with the driven portion 48*c* to be rotatable receives a load from the urging spring (not illustrated in the figure) in the direction of arrow S, the state is maintained in which the engaging bearing 49 is bought into contact with the bearing positioning portion 50. Accordingly, even in a case where the process cartridge 7 is mounted in the main assembly 100A again, the drum coupling 1*b* and the driven coupling (not illustrated in the figure) are engaged with each other, and accordingly, a configuration is formed in which a driving force can be transmitted to the photosensitive drum 1. In other words, when the cartridge 7 is mounted in the image forming apparatus 100, the driven portion 48*c* is located at a position being engaged with the drum coupling 1*b*.

Next, the driving transmission mechanism of the development roller 17 will be described with reference to FIGS. 12A, 12B, 12C, and 12D.

Figure 12A:
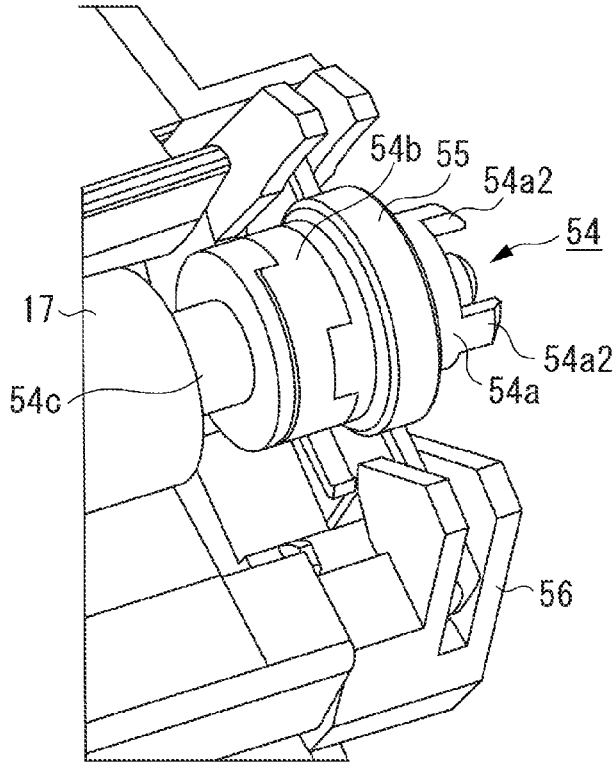
FIGS. 12A, 12B, 12C, and 12D are schematic diagrams illustrating a driving transfer mechanism for a development roller of the process cartridge.
Figure 12B:
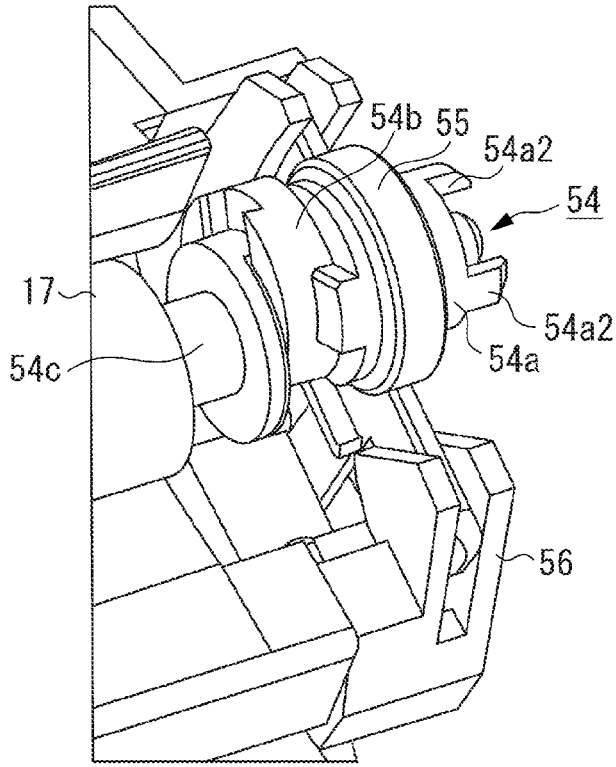
Figure 12C:
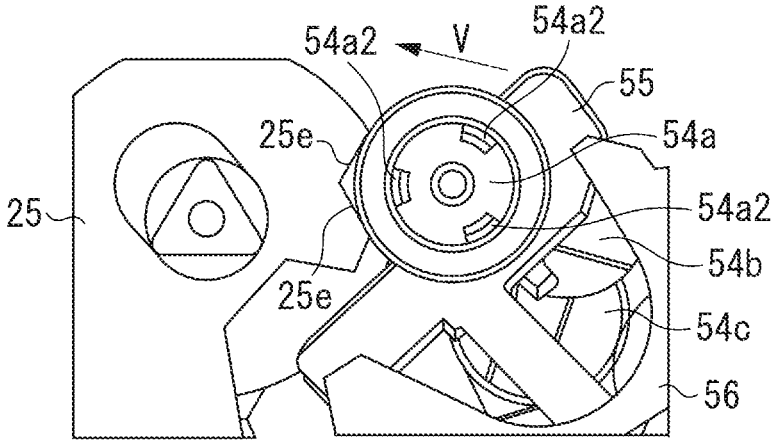

In the present exemplary embodiment, as a development roller driving transmission mechanism, a configuring using an Oldham's coupling is employed. FIG. 12A illustrates a driving transmission unit that transmits a driving force to the development roller 17 at the time of image formation, and FIG. 12B illustrates a driving transmission unit that transmits a driving force to the development roller 17 at the time of non-image formation. In addition, FIG. 12C illustrates a driving transmission unit when the cartridge 7 is taken out from the main assembly 100A at the time of non-image formation, and FIG. 12D illustrates the configuration of the development Oldham's coupling 54 for describing the configuration illustrated in FIG. 12A.

As illustrated in FIG. 12, the development Oldham's coupling 54 is configured by a driving portion 54*a*, a intermediate portion 54*b*, and a driven portion 54*c*.

Figure 12D:
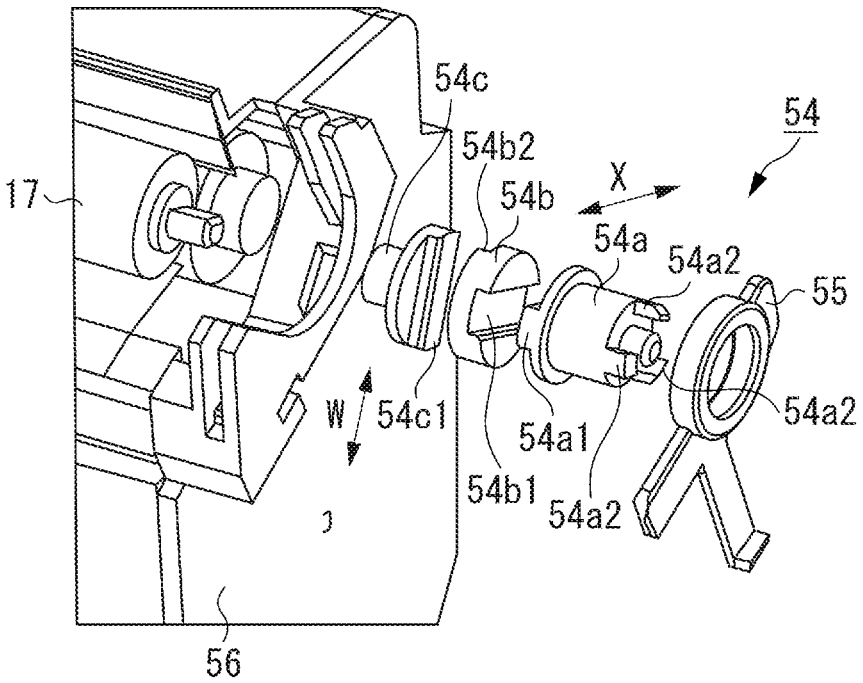

As illustrated in FIGS. 12A and 12D, at the time of image formation, each member of the development Oldham's coupling 54 is arranged on the same axis as that of the development roller 17. In the driving portion 54*a*, a development coupling 54*a*2 is disposed and is engaged with a development output coupling (not illustrated in the figure) disposed in the main assembly 100A, whereby a driving force is transmitted. By fitting a driving rib 54*a*1 disposed in the driving portion 54*a* into the driving groove 54*b*1 disposed in the intermediate portion 54*b*, a driving force is transmitted to the intermediate portion 54*b*. In the intermediate portion 54*b*, the driven groove 54*b*2 is disposed, and, by fitting the driven rib 54*c*1 disposed in the driven portion 54*c* into the driven groove 54*b*2, a driving force is transmitted to the driven portion 54*c*. The driven portion 54*c* is engaged with the development roller 17 in the shape of a D-cut, whereby a driving force is transmitted. The driving portion 54*a* is engaged with a engaging bearing 55 to be rotatable. In addition, the engaging bearing 55 receives a load from the urging spring (not illustrated in the figure) in the direction of arrow V.

As illustrated in FIG. 12B, at the time of non-image formation, the development roller 17 is moved to a position separated from the photosensitive drum 1. According to the movement of the development roller 17, the driven portion 54*c* that is engaged with the development roller 17 is moved together with the development roller 17. Meanwhile, the driving portion 54*a* is engaged with the development output coupling (not illustrated in the figure) of the main assembly 100A and accordingly, maintains the same position as the position at the time of image formation. Here, as illustrated in FIG. 12D, the intermediate portion 54*b* is configured to be slidable for the driving portion 54*a* in the direction of arrow X and be slidable for the driven portion 54*c* in the direction of arrow W. Accordingly, even when the driven portion 54*c* is moved according to the movement of the development roller 17, by moving the intermediate portion 54*b* in the direction of arrow W or in the direction of arrow X, the driving force delivered from the main assembly 100A can be transmitted to the development roller 17.

As illustrated in FIG. 12C, when the cartridge 7 is taken out from the main assembly 100A at the time of non-image formation, similarly to the case at the time of non-image formation, the driven portion 54*c* is engaged with the development roller 17, and accordingly, there is no change in the position. On the other hand, since the cartridge 7 is taken out from the main assembly 100A, the engagement of the development coupling 54*a*2 is released. However, the engaging bearing 55 engaged with the driving portion 54*a* to be rotatable receives a load from the development engaging urging spring (not illustrated in the figure) in the direction of arrow V, and accordingly, a state is maintained in which the engaging bearing 55 is brought into contact with the engaging bearing positioning portion 25*e* disposed in the photosensitive bearing 25. Accordingly, even in a case where the cartridge 7 is mounted in the main assembly 100A again, the development coupling 54*a*2 and the development output coupling (not illustrated in the figure) are configured to be engaged with each other to transmit a driving force to the development roller 17.

In addition, when the photosensitive drum 1 is located at a non-acting position, in a case where the cartridge 7 is taken out from the main assembly 100A, as illustrated in FIGS. 6B and 10A, a state is formed in which the photosensitive drum 1 is brought into contact with the cleaning blade 6 and the toner sealing member 24. Therefore, the recovered residual toner does not leak from the removal toner chamber 14*a* to the outside.

In the present exemplary embodiment, as a unit that moves the photosensitive drum 1 to the acting position or the non-acting position, the pressing contact force of the pressing contact member that is necessary for image formation is used. However, the present invention is not limited thereto, and a toggle mechanism or a urging member such as a spring may be used.

As described above, according to the present exemplary embodiment, the cartridge 7 is configured such that the development roller 17, the charging roller 2, and the primary transfer roller 8 are brought into contact with the photosensitive drum 1 only at the time of image formation. Furthermore, at the time of non-image formation, it is configured to maintain a state in which the development roller 17, the charging roller 2, and the primary transfer roller 8 are separated from the photosensitive drum 1, and a state in which the pressing force of the cleaning blade 6 and the toner sealing member 24 is extremely small. Accordingly, the deformation of the pressing contact member or the cleaning frame 14 due to being subjected to be pressed for a long time can be prevented. In addition, even in a case where the cartridge 7 is taken out from the main assembly 100A, a state in which the removal toner chamber 14*a* is closed can be maintained while maintaining the state of separation between the photosensitive drum 1 and the pressing contact member, whereby the recovered residual toner does not leak.

In addition, when the cartridge 7 is attached to or detached from the main assembly 100A in the direction of the axis line of the photosensitive drum 1, it can be attached to or detached from the image forming apparatus by employing a simple configuration while preventing the sliding with the transfer unit. Furthermore, the mounting can be performed only in the direction of the axis line, and accordingly, the size in the image forming apparatus 100 can be decreased. In addition, since the photosensitive drum 1 is maintained without any rattle for the support frame, even when an impact is applied in the process of the product distribution, the photosensitive drum 1 is fixed, and accordingly, the occurrence of scratches or damages can be reduced. Furthermore, by moving the photosensitive drum 1 by using the development separation mechanism that exists in the main body, it is possible to move the photosensitive drum 1 at low price without arranging a special mechanism.

A second exemplary embodiment will now be described. In the first exemplary embodiment, an example has been described in which the development roller 17 and the photosensitive drum 1 are separated from each other when the developing unit 4 secures a non-development position. However, in a case where the photosensitive drum 1 is moved from an acting position to a non-acting position, it is not necessary for the non development position of the developing unit 4 to become a state where the development roller 17 is separated from the photosensitive drum 1. In other words, it may be configured such that, as the developing unit 4 slightly moves from a development position, in the state in which the developing roller 17 and the photosensitive drum 1 are brought into contact with each other, the photosensitive drum 1 is moved from the acting position to the non-acting position based on one's own weight thereof.

As described above, according to an exemplary embodiment of the invention, by using the development separating configuration, the process unit that acts while being brought into contact with the photosensitive drum can be maintained to be separated from the photosensitive drum or to be in a state in which the pressing force is decreased at the time of non-image formation.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-066251 filed Mar. 24, 2011, which is hereby incorporated by reference herein in its entirety.

What is claimed is:

1. A process cartridge detachably attached to a main assembly of an electrophotographic image forming apparatus, the process cartridge comprising:

a photosensitive member unit configured to include a photosensitive drum;

a development roller configured to develop an electrostatic latent image formed on the photosensitive drum using a developer;

a developing unit configured to include the development roller and to be combined with the photosensitive member unit to be movable, wherein the developing unit secures a development position at which the developing roller develops the electrostatic latent image and a non-development position at which the developing roller retreats from the development position;

a process unit configured to act on the photosensitive drum by contacting the photosensitive drum; and a support member disposed within the photosensitive member unit and configured to support the photosensitive drum such that the photosensitive drum is movable with respect to the photosensitive member unit, wherein the photosensitive drum moves with respect to the photosensitive member unit and is thereby permitted to secure an acting position at which the photosensitive drum is brought into contact with the process unit, and a non-acting position at which the photosensitive drum is separated from the process unit or is brought into contact with the process unit with a pressure lower than a pressure with which the photosensitive drum contacts the process unit at the acting position, and wherein, by the development roller urging the photosensitive drum, the photosensitive drum is permitted to secure the acting position when the developing unit is located at the development position, and by the development roller retreating, the photosensitive drum is permitted to secure the non-acting position when the developing unit is located at the non-development position.

2. The process cartridge according to claim 1, wherein the process unit is a charging unit configured to charge the photosensitive drum.

3. The process cartridge according to claim 1, wherein the process unit is a cleaning unit configured to remove a developer from the photosensitive drum.

4. The process cartridge according to claim 3, wherein the process unit further comprises a sealing member for preventing the developer removed by the cleaning unit from leaking to an outside of the photosensitive member unit.

5. The process cartridge according to claim 1, wherein the support member is an elongate hole disposed in the photosensitive member unit for supporting the photosensitive drum to be rotatable and slidable between the acting position and the non-acting position.

6. The process cartridge according to claim 2, wherein the charging unit is configured to be disposed in the developing unit.

7. The process cartridge according to claim 1, wherein the developing unit further comprises a force receiving member for receiving a force from the main assembly for moving the photosensitive drum from the development position to the non-development position.

8. An electrophotographic image forming apparatus comprising:

a process cartridge including, a photosensitive member unit configured to include a photosensitive drum, a development roller configured to develop an electrostatic latent image formed on the photosensitive drum using a developer, a developing unit configured to include the development roller and to be combined with the photosensitive member unit to be movable, wherein the developing unit secures a development position, which the developing roller develops the electrostatic latent image, and a non-development position, which the developing roller retreats from the development position, a process unit configured to act on the photosensitive drum by contacting the photosensitive drum, and a supporting member disposed within the photosensitive member unit and configured to support the photosensitive drum such that the photosensitive drum is movable with respect to the photosensitive member unit, wherein the photosensitive drum moves with respect to the photosensitive member unit and is thereby permitted to secure an acting position at which the photosensitive drum is brought into contact with the process unit, and a non-acting position at which the photosensitive drum is separated from the process unit or is brought into contact with the process unit with a pressure lower than a pressure with which the photosensitive drum contacts the process unit at the acting position, and wherein, by the development roller urging the photosensitive drum, the photosensitive drum is permitted to secure the acting position when the developing unit is located at the development position, and by the development roller retreating, the photosensitive drum is permitted to secure the non-acting position when the developing unit is located at the non-development position; and a mounting unit configured to detachably attach the process cartridge.

9. The electrophotographic image forming apparatus according to claim 8, wherein the process unit is a charging unit configured to charge the photosensitive drum.

10. The electrophotographic image forming apparatus according to claim 8, wherein the process unit is a cleaning unit configured to remove a developer from the photosensitive drum.

11. The electrophotographic image forming apparatus according to claim 10, wherein the process unit further comprises a sealing member for preventing the developer removed by the cleaning unit from leaking to an outside of the photosensitive member unit.

12. The electrophotographic image forming apparatus according to claim 8, wherein the support member is an elongate hole disposed in the photosensitive member unit for supporting the photosensitive drum to be rotatable and slidable between the acting position and the non-acting position.

13. The electrophotographic image forming apparatus according to claim 9, wherein the charging unit is configured to be disposed in the developing unit.

14. The electrophotographic image forming apparatus according to claim 8, wherein the developing unit further comprises a force receiving member for receiving a force from the main assembly of the electrophotographic image forming apparatus for moving the photosensitive drum from the development position to the non-development position.

15. The electrophotographic image forming apparatus according to claim 8, further comprising an intermediate transfer member to which a developed image formed on the photosensitive drum is transferred, wherein, the photosensitive drum is brought into contact with the intermediate transfer member when the photosensitive drum secures the acting position, and the photosensitive drum is separated from the intermediate transfer member when the photosensitive drum secures the non-acting position.

16. The electrophotographic image forming apparatus according to claim 8, further comprising a guide member for moving the developing unit to the non-acting position when the process cartridge is mounted in the main assembly of the electrophoretic image forming apparatus from a direction of a shaft line of the photosensitive drum.

17. The electrophotographic image forming apparatus according to claim 8, further comprising:

a main body driving member for driving the photosensitive drum; and a drive transmission member for transmitting a driving force from the main body driving member to the photosensitive drum with allowing a deviation from an axis line of the main body driving member, and which includes an engagement portion maintained at a position to engage with the photosensitive drum located at the non-acting position when the process cartridge is mounted in the electrophotographic image forming apparatus in the direction of the axis line of the photosensitive drum, and installed to be movable in a direction intersecting the axis line of the main body driving member.

18. The electrophotographic image forming apparatus according to claim 17, further comprising an urging member for pushing the engagement portion in an intersecting direction.

19. The electrophotographic image forming apparatus according to claim 17, wherein the drive transmission member is an Oldham's coupling.

20. The electrophotographic image forming apparatus according to claim 8, wherein the electrophotographic image forming apparatus is a color electrophotographic image forming apparatus including a plurality of the process cartridges.

21. The process cartridge according to claim 1, wherein in a case where the developing unit moves from the development position to the non-development position, the photosensitive drum is moved from the acting position to the non-acting position according to its own weight.

22. The process cartridge according to claim 1, wherein, by the process unit urging the development roller and the photosensitive drum, the developing unit is permitted to secure the photosensitive drum at the acting position when the developing unit is located at the development position.

23. The process cartridge according to claim 1, wherein, by the development roller pressing the photosensitive drum, the photosensitive drum is permitted to move from the non-acting position to the acting position when the developing unit moves from the non-development position to the development position, and, by the development roller retreating from the photosensitive drum, the photosensitive drum is permitted to move from the acting position to the non-acting position when the developing unit moves from the development position to the non-development position.

* * * * *